US007686059B2

(12) United States Patent
Jarosinski et al.

(10) Patent No.: US 7,686,059 B2
(45) Date of Patent: Mar. 30, 2010

(54) TOP DOWN/BOTTOM UP CONTROL SYSTEM FOR RETRACTABLE SHADE

(75) Inventors: Marek Jarosinski, Brighton, CO (US); Ralph G. Jelic, Boulder, CO (US); Paul F. Josephson, Longmont, CO (US); Daniel Fluckey, Englewood, CO (US); Ronald Holt, Westminster, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 191 days.

(21) Appl. No.: 11/839,658

(22) Filed: Aug. 16, 2007

(65) Prior Publication Data

US 2008/0053626 A1 Mar. 6, 2008

Related U.S. Application Data

(60) Provisional application No. 60/824,490, filed on Sep. 5, 2006.

(51) Int. Cl.
*E06B 9/264* (2006.01)

(52) U.S. Cl. ..... 160/84.03; 160/167 R; 160/170; 160/171; 160/168.1 R; 160/173 R; 160/178.1 R

(58) Field of Classification Search ..... 160/84.03, 160/167 R, 170, 171, 168.1 R, 173 R, 178.1 R
See application file for complete search history.

(56) References Cited

U.S. PATENT DOCUMENTS 5,908,062 A * 6/1999 Fun ..... 160/170
6,012,506 A * 1/2000 Wang et al. ..... 160/170
6,530,413 B2 * 3/2003 Hwang ..... 160/84.03
6,530,415 B2 * 3/2003 Wu ..... 160/168.1 R
6,536,503 B1 * 3/2003 Anderson et al. ..... 160/170
6,588,480 B2 * 7/2003 Anderson ..... 160/170
6,758,257 B2 * 7/2004 Lee ..... 160/166.1
6,782,937 B2 * 8/2004 Anderson et al. ..... 160/84.05
6,786,270 B2 * 9/2004 Wen et al. ..... 160/170
6,789,597 B2 * 9/2004 Wen et al. ..... 160/168.1 P
6,834,701 B2 * 12/2004 Colson et al. ..... 160/121.1
6,845,802 B1 * 1/2005 Anderson et al. ..... 160/115

(Continued)

FOREIGN PATENT DOCUMENTS

WO WO 2007/038447 A2 4/2007

(Continued)

*Primary Examiner*—Katherine W Mitchell
*Assistant Examiner*—Philip S Kwon
(74) *Attorney, Agent, or Firm*—Dorsey & Whitney LLP

(57) ABSTRACT

A control system for a top down/bottom up covering for an architectural opening includes a head rail and an independently moveable bottom rail and middle rail. A shade material extends between the middle rail and the bottom rail and control systems are provided at opposite ends of the head rail for operating the middle rail independently of the bottom rail. Each control system includes lift spools associated with lift cords that are secured to the bottom rail or middle rail with the lift spools being seated in cradles and rotated by a drive shaft connected to manually operated control elements. Each drive shaft is operatively connected to a braking system in the form of a two-way clutch so the drive shafts can be rotated in either direction to raise or lower a bottom or middle rail, but locked in any selected position.

10 Claims, 26 Drawing Sheets

U.S. PATENT DOCUMENTS

| | | | | |
|---|---|---|---|---|
| 6,854,502 | B2 * | 2/2005 | Lai | 160/89 |
| 6,968,884 | B2 * | 11/2005 | Anderson et al. | 160/170 |
| 6,991,020 | B1 * | 1/2006 | Cheng et al. | 160/168.1 R |
| 7,063,122 | B2 * | 6/2006 | Colson et al. | 160/84.03 |
| 7,143,802 | B2 * | 12/2006 | Strand et al. | 160/84.04 |
| 7,159,635 | B2 * | 1/2007 | Holt et al. | 160/84.05 |
| 7,360,574 | B2 * | 4/2008 | Maumi et al. | 160/170 |
| 2002/0050539 | A1 * | 5/2002 | Anderson | 242/170 |
| 2003/0024656 | A1 * | 2/2003 | Ciuca | 160/170 |
| 2004/0182522 | A1 * | 9/2004 | Strand et al. | 160/84.05 |
| 2004/0182526 | A1 * | 9/2004 | Strand et al. | 160/170 |
| 2005/0217805 | A1 * | 10/2005 | Strand et al. | 160/168.1 P |
| 2006/0118248 | A1 * | 6/2006 | Anderson et al. | 160/84.04 |
| 2007/0039696 | A1 * | 2/2007 | Strand et al. | 160/84.04 |
| 2007/0074826 | A1 * | 4/2007 | Jelic et al. | 160/84.05 |
| 2007/0107854 | A1 * | 5/2007 | Jelic | 160/170 |
| 2007/0144686 | A1 * | 6/2007 | Drew | 160/170 |
| 2008/0093034 | A1 * | 4/2008 | Anderson et al. | 160/170 |
| 2008/0295977 | A1 * | 12/2008 | Liang et al. | 160/168.1 R |

FOREIGN PATENT DOCUMENTS

| | | | |
|---|---|---|---|
| WO | WO 2007/038447 | A3 | 4/2007 |

* cited by examiner

TOP DOWN/BOTTOM UP CONTROL SYSTEM FOR RETRACTABLE SHADE

CROSS REFERENCE TO RELATED APPLICATION

The present application claims the benefit under 35 U.S.C. § 119(e) to U.S. Provisional Patent Application No. 60/824,490 ("the '490 application"), which was filed on Sep. 5, 2006, and entitled Top Down/Bottom Up Control System for Retractable Shade." The '490 application is incorporated by reference into the present application in its entirety.

BACKGROUND OF THE INVENTION

1. Field of the Invention

This invention relates generally to retractable coverings for architectural openings or the like that include a fixed head rail, a vertically moveable bottom rail and a vertically moveable middle rail with a shade material extending between the middle rail and the bottom rail. The shade material is flexible and retractable such that it can be extended between the middle rail and bottom rail or stacked in a retracted condition between the middle rail and the bottom rail. A control system is adapted to reciprocally move the middle rail independently of reciprocal movement of the bottom rail. The shade material can therefore be extended or retracted between the middle rail and the bottom rail and positionable between a retracted position adjacent to the head rail and extended positions displaced from the head rail.

2. Description of the Relevant Art

Coverings for architectural openings such as windows, doors, archways and the like, have taken numerous forms over many years. Early simple forms of such coverings amounted to fabric draped or otherwise suspended across an opening while in recent years more sophisticated coverings have been developed.

By way of example, Venetian blinds have become a popular form of covering for architectural openings wherein a plurality of vertically spaced horizontally extending slats are pivotably supported by cord ladders so that the slats can be pivoted or tilted about horizontal longitudinal axis to move the covering between open and closed positions or the slats can be gathered into a vertical stack adjacent to the top of the architectural opening in a retracted condition of the covering.

Other forms of retractable coverings utilize various shade materials that can be extended or retracted from a head rail of the covering to a bottom rail and in some instances, a middle rail is provided between the head rail and the bottom rail. In such coverings, the shade material extends between the middle rail and the bottom rail and both the middle rail and the bottom rail can be independently moved relative to the head rail to vary the extension, retraction or placement of the shade material relative to the architectural opening in which the covering is mounted.

Shade materials can be of numerous types including those of the type described in co-pending U.S. application Ser. No. 10/581,872 filed Jun. 5, 2006, which application is the Section 371 (c) filing of PCT International application No. PCT/US2004/043043 entitled Retractable Shade for Coverings for Architectural Openings filed Dec. 21, 2004 wherein a plurality of horizontally disposed arcuate vanes are suspended off the front and rear face of a flexible support structure that is suspended from the head rail. the vanes can be gathered in a retracted condition by raising a bottom rail toward the head rail. Of course, the reverse movement of the bottom rail causes the shade material to extend.

The coverings which include a middle rail independently moveable relative to the bottom rail and head rail are commonly referred to as top down/bottom up shades inasmuch as the top of the shade can be lowered by dropping the middle rail and the bottom of the shade can be raised by raising the bottom rail. The independent movability of the middle and bottom rails enables an operator to position the shade material at any location in the architectural opening and to any extended state and accordingly, these coverings have become very popular.

As will be appreciated, the control systems for raising and lowering a middle rail relative to a head rail and independently of a movable bottom rail can be fairly complicated, but in order to assure reliable and extended operation of such control systems, it is desirable to keep them simple, and accordingly, attempts in the art are continually being made to simplify and thereby improve control systems for top down/bottom up coverings. The present invention has been developed for this purpose.

SUMMARY OF THE INVENTION

The retractable covering of the present invention is of the top down/bottom up type and includes a fixed head rail incorporating the control system of the present invention, a vertically and reciprocally moveable bottom rail, a vertically and reciprocally moveable middle rail, and a flexible and retractable shade material extending between the middle and bottom rails. The control system includes two pairs of lift cords with one pair associated with the bottom rail and the other associated with the middle rail and wherein each pair of lift cords moves in unison to raise or lower the rail with which it is associated. Each pair of lift cords is independently moveable relative to the other pair so that the middle rail can be raised and lowered independently of the bottom rail.

It will therefore be appreciated the shade material can be fully retracted adjacent the head rail if both the middle rail and bottom rail are fully retracted adjacent to the head rail or the shade material can be fully extended across the architectural opening in which the covering is mounted by retaining the middle rail adjacent to the head rail and fully extending or lowering the bottom rail so the shade material extends completely across the architectural opening. The shade material can also be extended to any desired degree and positioned at any position within the architectural opening by independently moving the middle rail and bottom rail relative to each other and relative to the fixed head rail.

The control system includes two parallel drive shafts disposed in tandem within the head rail with each drive shaft having a pair of take-up spools associated with a pair of lift cords. Each pair of take-up spools is mounted on its drive shaft for unitary rotation with its associated drive shaft and the drive shafts are reversibly rotatable about their longitudinal axes so that the spools associated therewith can be rotated in either direction to wrap the associated lift cords thereabout or unwrap them therefrom.

Each drive shaft also has its own drive wheel having a flexible control cord connected thereto such that movement in one direction or another of the drive wheel rotates the drive shaft accordingly. Each drive shaft is also provided with a two-way clutch so that movement of the control cord in one direction or another releases the clutch to allow the drive shaft to rotate. When the control cord is not being moved, the clutch acts as a brake in holding the drive shaft and accordingly its associated spools and lift cords in a predetermined and fixed position.

It will be appreciated from the above that each of the drive shafts can be independently moved with its control cord in either direction so that the middle rail and bottom rail associated with the respective drive shafts can be raised or lowered accordingly. In this manner, the shade material extending between the middle and bottom rails can also be extended or retracted and positioned as desired within the architectural opening in which the covering is mounted.

Other aspects, features and details of the present invention can be more completely understood by reference to the following description of the preferred embodiment, taken in conjunction with the drawings and from the impendent claims.

DESCRIPTION OF THE PREFERRED EMBODIMENT

Figure 1:
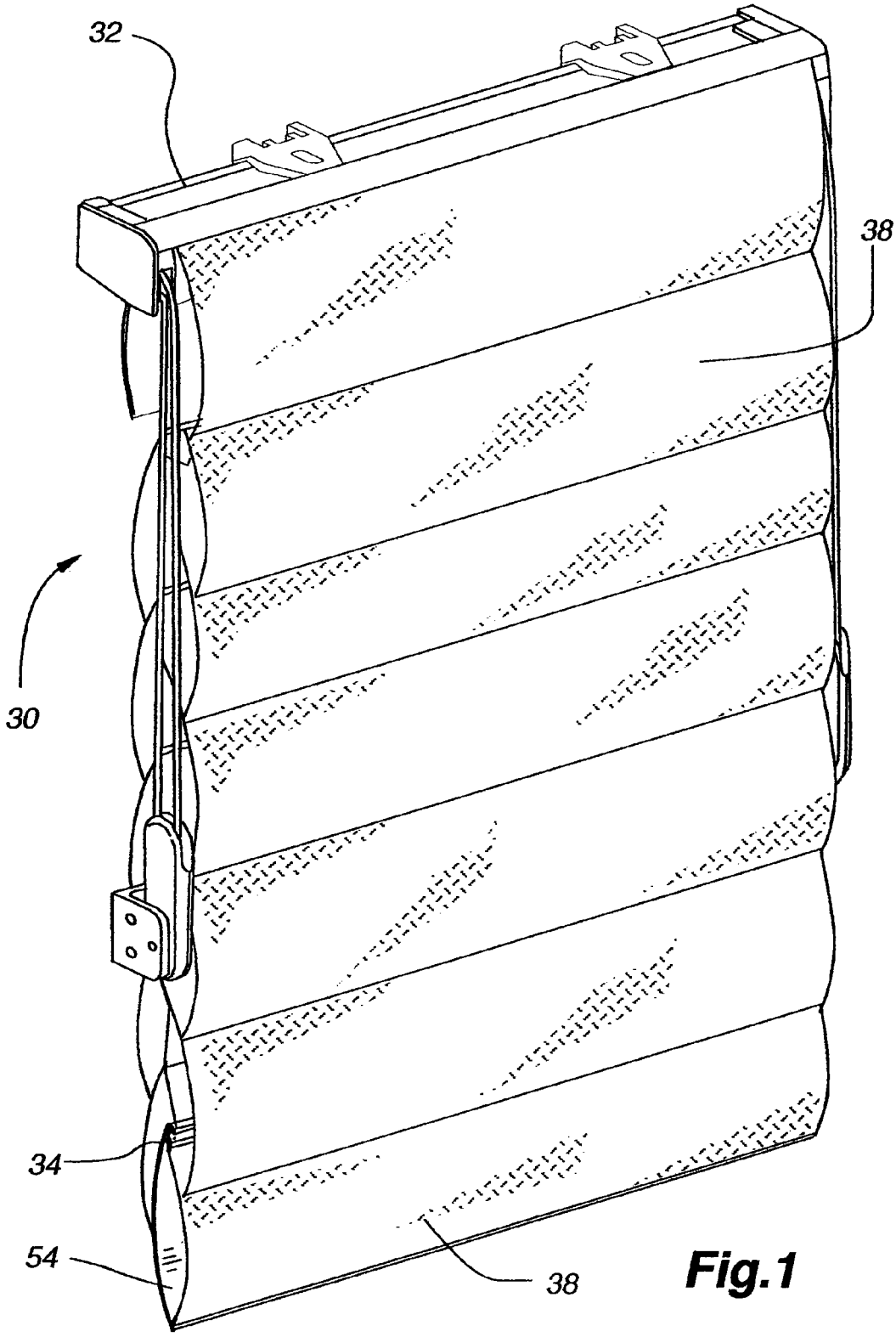
FIG. 1 is an isometric view of a covering with the present invention incorporating the control system of the present invention with the covering in a fully extended position.

The control system of the present invention finds use in a top down/bottom up covering 30 for an architectural opening wherein the covering is possibly best appreciated by reference to FIGS. 1, 25A, 25B and 25C and includes a head rail 32, a bottom rail 34, a middle rail 36, and a flexible shade material 38 extending between the middle rail and the bottom rail. As will be appreciated with the description that follows, the control system is adapted to independently move the middle rail and the bottom rail toward and away from the head rail so that the shade material can be extended or retracted to any desired degree and at any location within the architectural opening in which the covering is mounted.

Figure 25A:
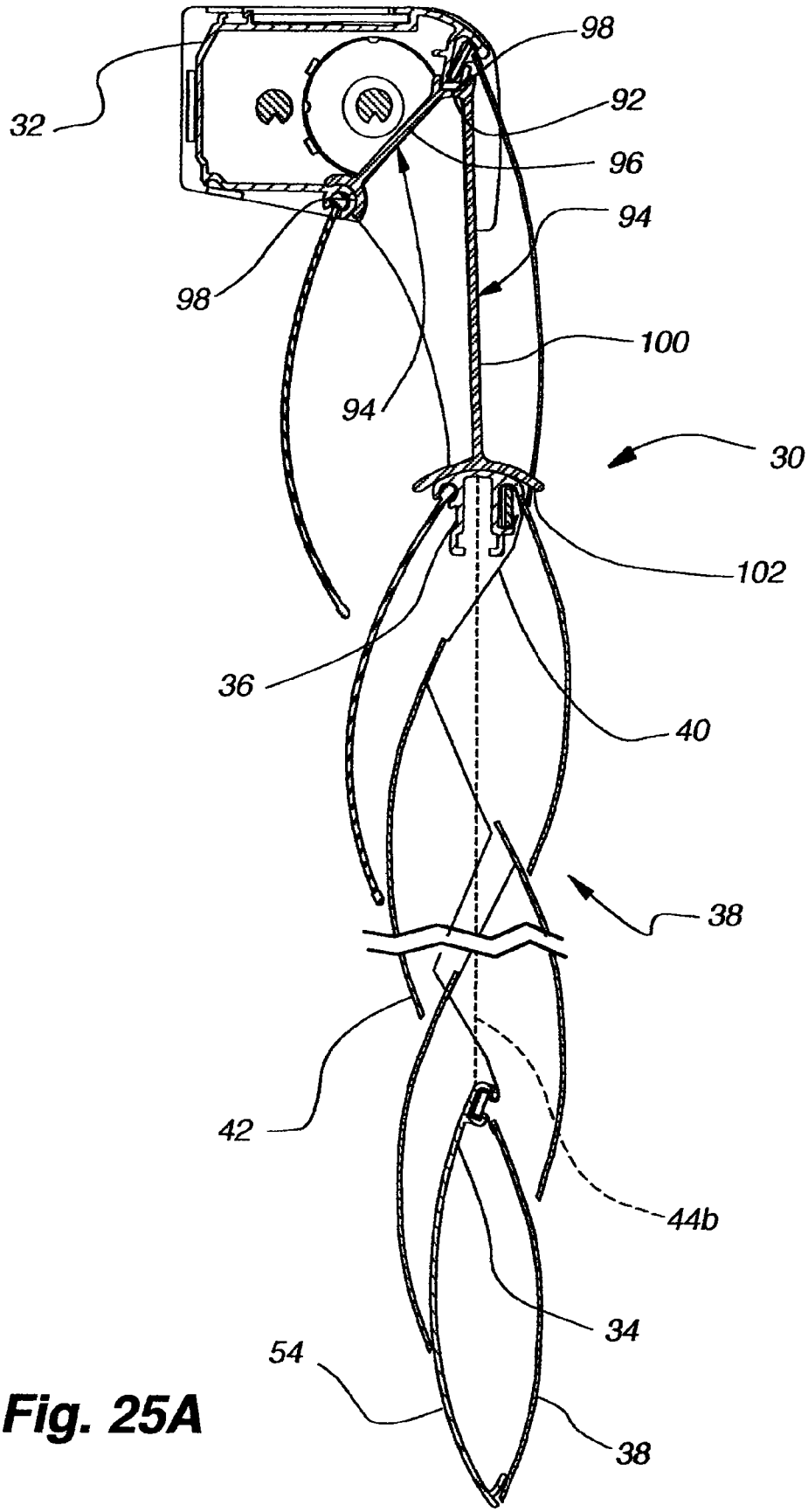
FIG. 25A is an enlarged fragmentary section taken along line 25A-25A of FIG. 2.
Figure 25B:
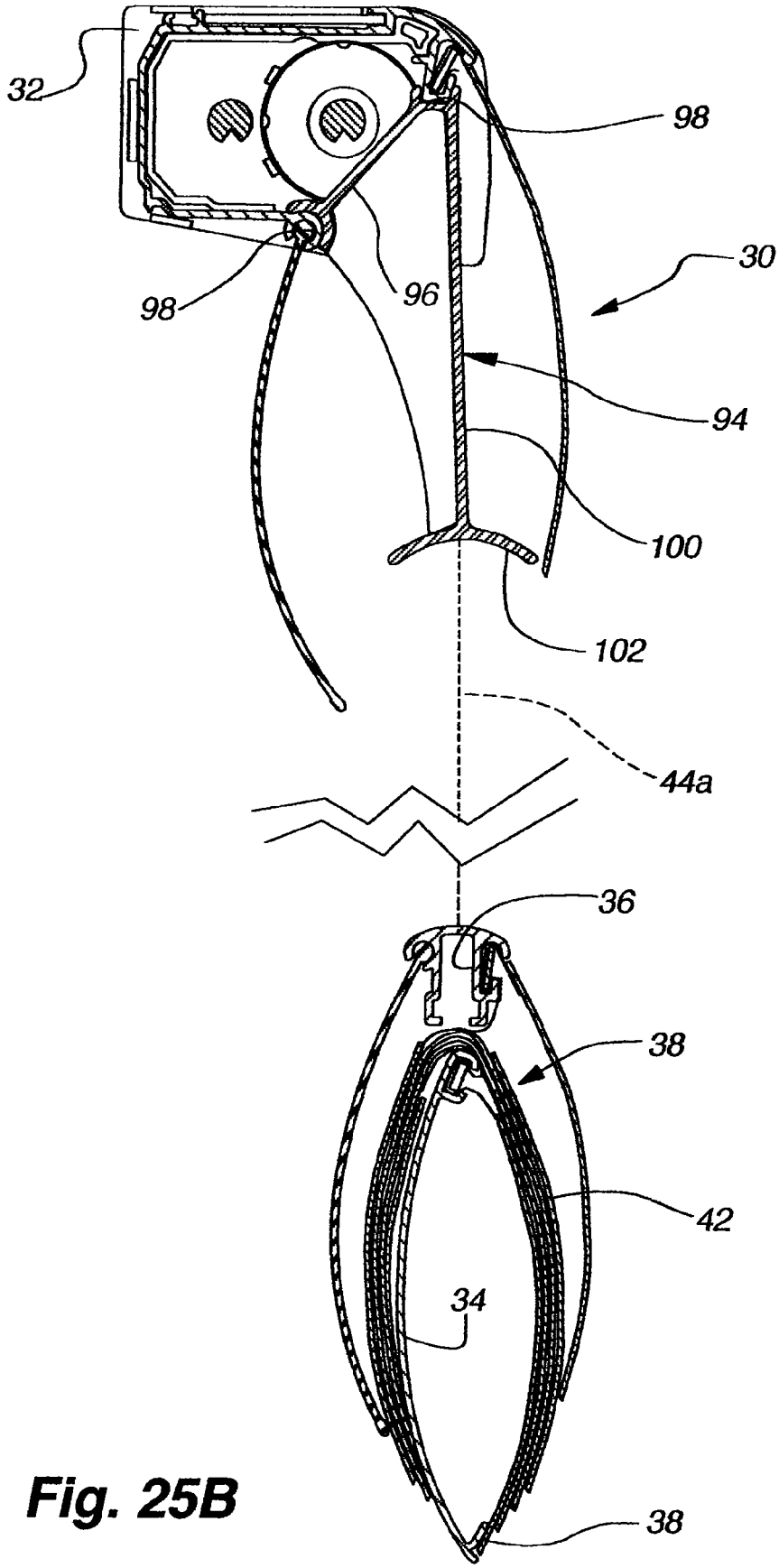
FIG. 25B is a section similar to FIG. 25A with the middle rail having been lowered from its fully raised position of FIG. 25A.
Figure 25C:
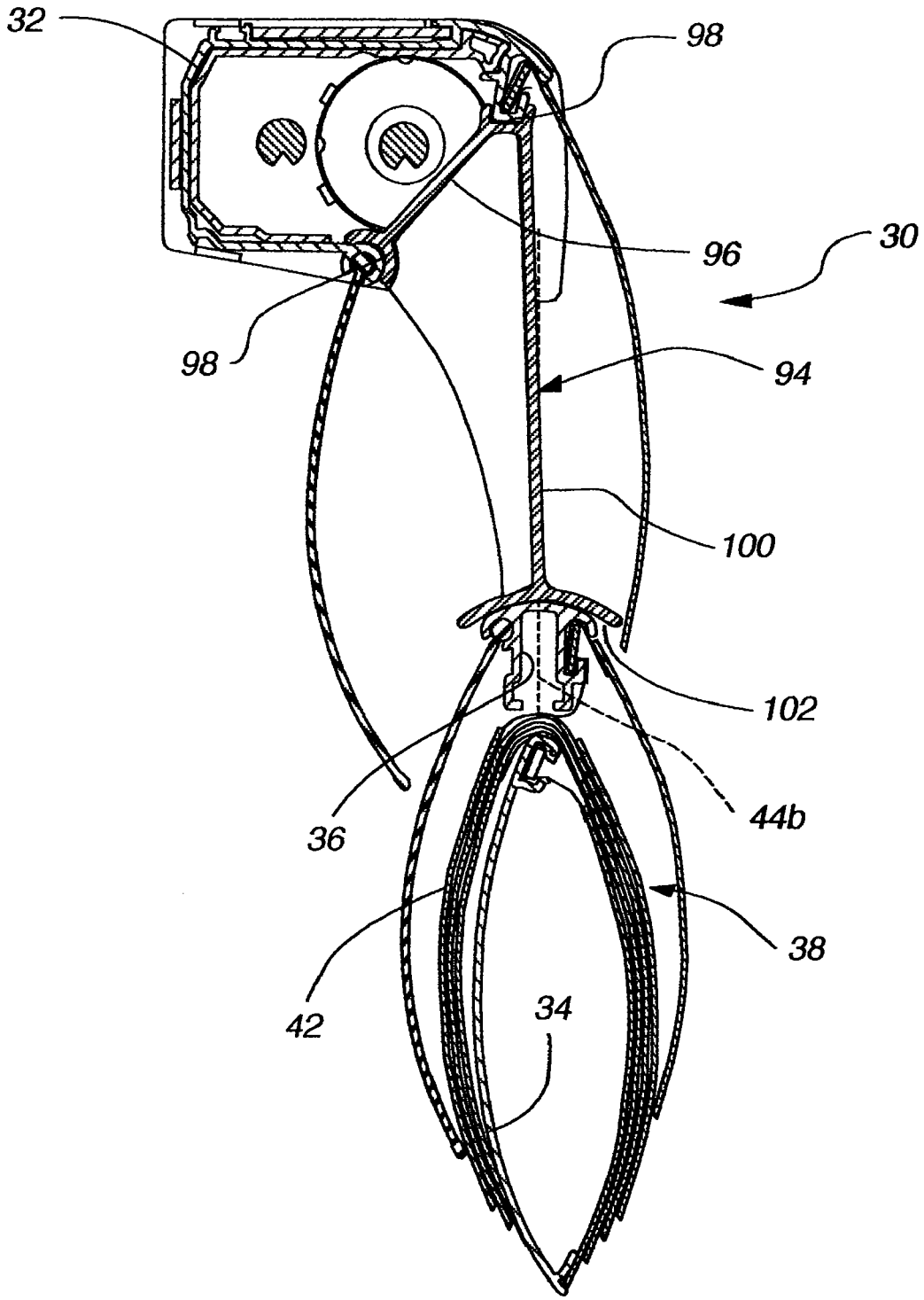
FIG. 25C is a section similar to FIG. 25A with the bottom rail having been fully raised along with the middle rail.

The shade material 38 could be one of numerous flexible materials found and used in coverings for architectural openings but for purposes of describing the control system of the present invention, the shade material has been illustrated for exemplary purposes only as a shade material of the type described in co-pending U.S. application Ser. No. 10/581,872 filed Jun. 5, 2006, which application is the Section 371 (c) filing of PCT International application No. PCT/UC2004/043043 filed Dec. 21, 2004 and entitled Retractable Shade for Coverings for Architectural Openings which is of common ownership with the present application and is hereby incorporated by reference. That shade material includes a flexible support structure 40 (FIG. 25A) suspended from the head rail 32 with the support structure taking one of numerous forms including a flexible sheet of fabric material, a plurality of vertically suspended cords or strips of fabric or the like. Arcuate rigid or semi-rigid vanes 42 are alternately suspended off a front and rear face of the support structure so as to overlap when the support structure is fully extended as shown in FIGS. 1 and 25A. When the bottom rail 34 is raised relative to the middle rail 36, the support structure is gathered along with the vanes that are supported thereon so that the vanes become nested with each other as shown in FIGS. 25B and 25C. In FIG. 25B, the middle rail is shown extended some distance from the head rail while in FIG. 25C, the middle rail is shown fully retracted against the head rail, but in both views, the shade material is fully retracted by raising the bottom rail into adjacent or close proximity to the middle rail.

Figure 1A:
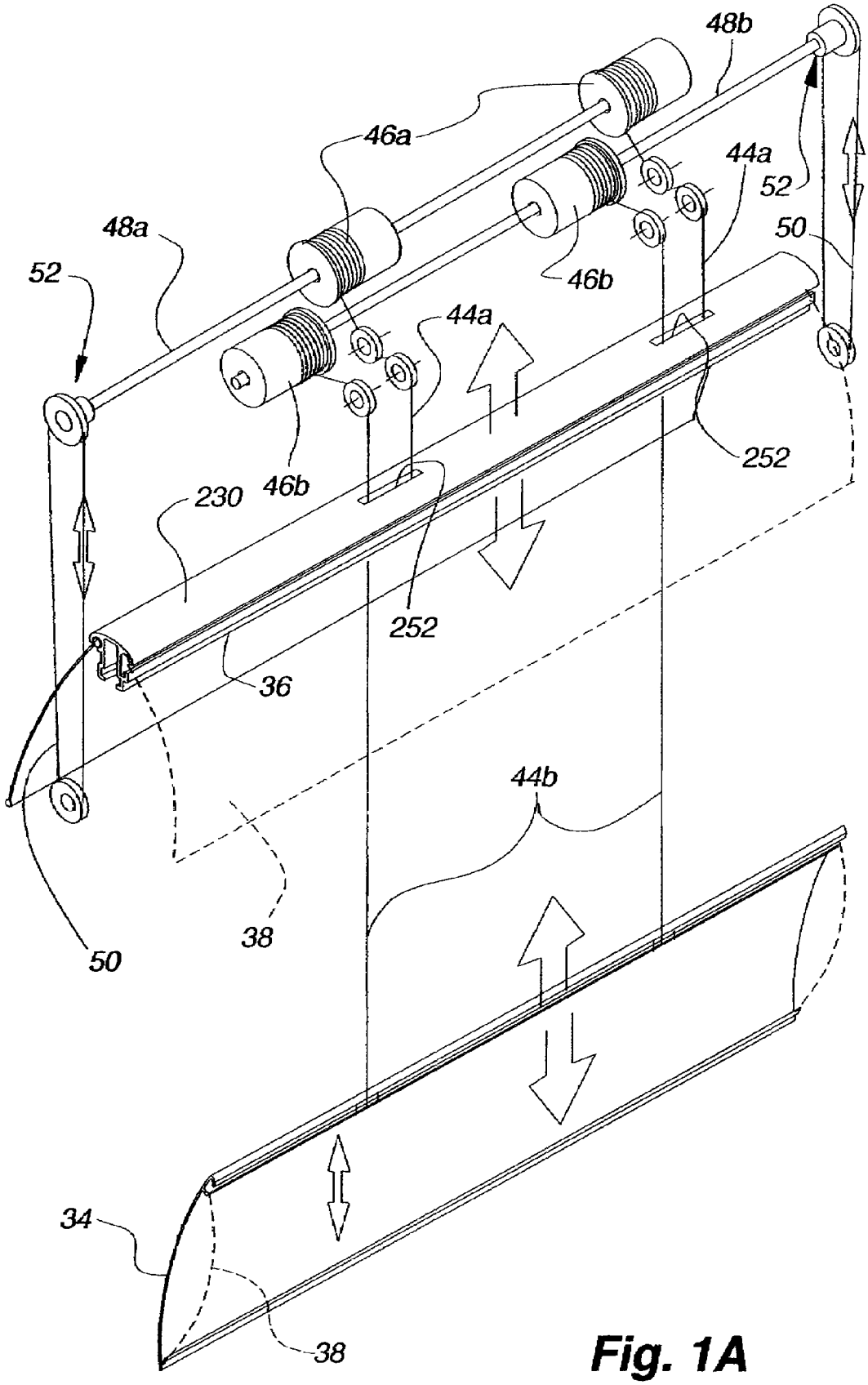
FIG. 1A is a diagrammatic isometric view showing the lift systems for the bottom and middle rails of the covering of FIG. 1.

Referring to the diagrammatic illustration in FIG. 1A, the system for independently moving the bottom rail 34 and middle rail 36 relative to the head rail 32 is shown. There are two independent systems for raising and lowering the bottom rail and middle rail respectively with each system including a pair of lift cords 44*a* or 44*b* extending between their associated rail and a pair of spools 46*a* or 46*b* mounted on a drive shaft 48*a* or 48*b* in the head rail. The spools are adapted to rotate in unison with the associated drive shaft and the drive shafts are in turn manually rotated with endless control elements 50 even though the drive shafts could be electrically driven as would be evident to those skilled in the art. At each end of the head rail and as will be described in more detail hereafter, a brake system 52 in the form of a two-way clutch is operatively connected to each drive shaft so that the drive shafts can be freely rotated in either direction, but will remain in a fixed position when the control element 50 is not rotating the drive shaft. Accordingly, it will be seen that rotation of one drive shaft 48*a* in a first direction causes the lift cords 44*a* associated with the middle rail 36 to be wrapped around the spools on that drive shaft thereby raising the middle rail or rotation of the drive shaft 48*a* in the opposite direction unwinds the lift cords 44*a* from the associated spools allowing the middle rail to drop by gravity. Similarly, with the bottom rail 34, the lift cords 44*b* associated therewith are wrapped around their associated spools upon rotation of the associated drive shaft 48*b* in one direction while allowed to be unwrapped from the spools to allow the bottom rail to drop by gravity with rotation in the opposite direction.

Figure 2:
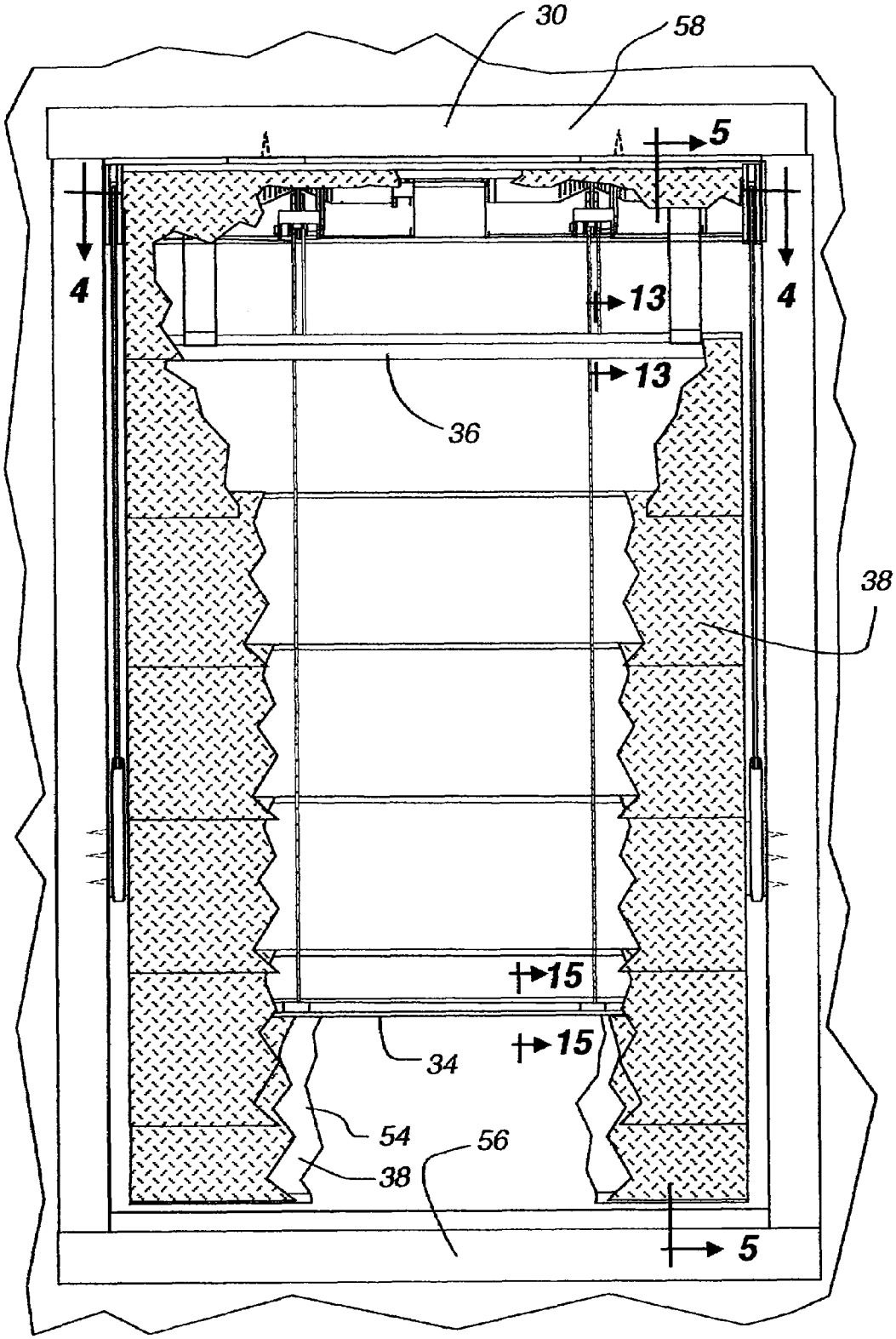
FIG. 2 is a front elevation of the covering of FIG. 1 with parts removed for clarity.

Referring to FIG. 2, the covering 30 is shown in a fully extended position with the middle rail 36 being elevated or retracted into engagement with the head rail 32 and the bottom rail 34 fully extended so that a dummy vane 54 forming a part thereof is closely spaced from or slightly engaged with the sill 56 of the architectural opening in which the covering is mounted. As will be appreciated, the lift cords 44*a* associated with the middle rail 36 are wrapped fully around their associated spools 46*a* and the lift cords 44*b* associated with the bottom rail 34 are unwrapped from their spools 46*b*. Further, the shade material 38 is evenly distributed across the architectural opening as can also be seen in FIG. 1 when the covering is in its fully extended position.

Figure 10:
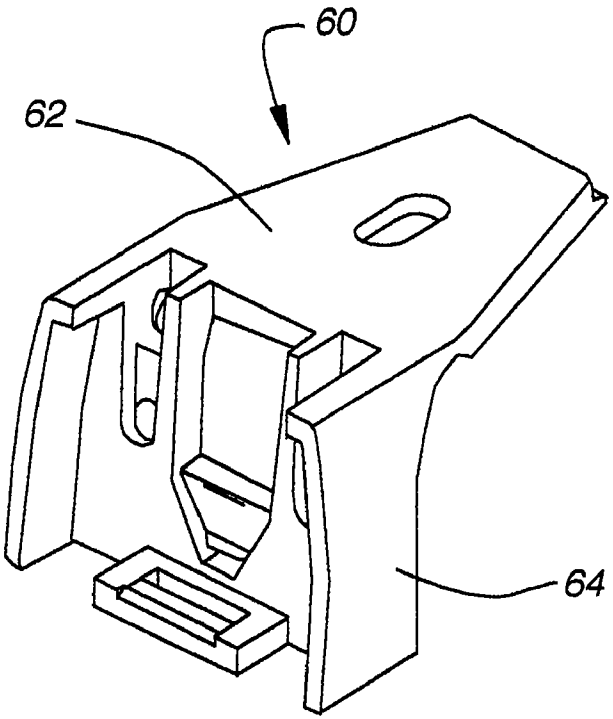
FIG. 10 is an isometric similar to FIG. 9 looking at the rear side of the mounting bracket.
Figure 9:
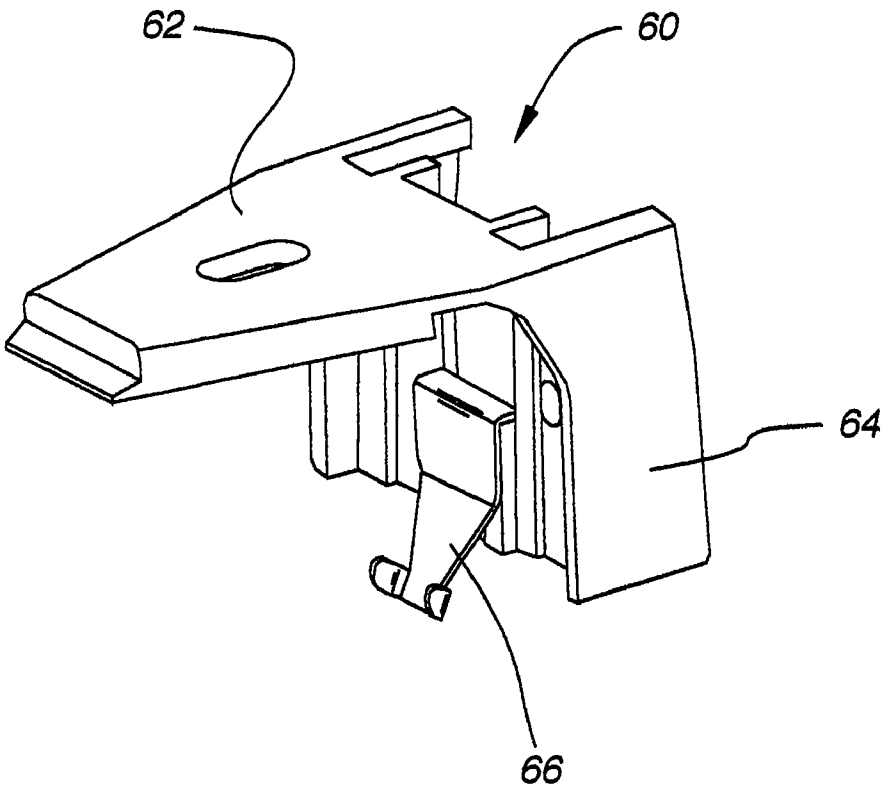
FIG. 9 is an isometric looking at the front of a mounting bracket for securing the head rail of the covering of the invention to a supporting surface.
Figure 11A:
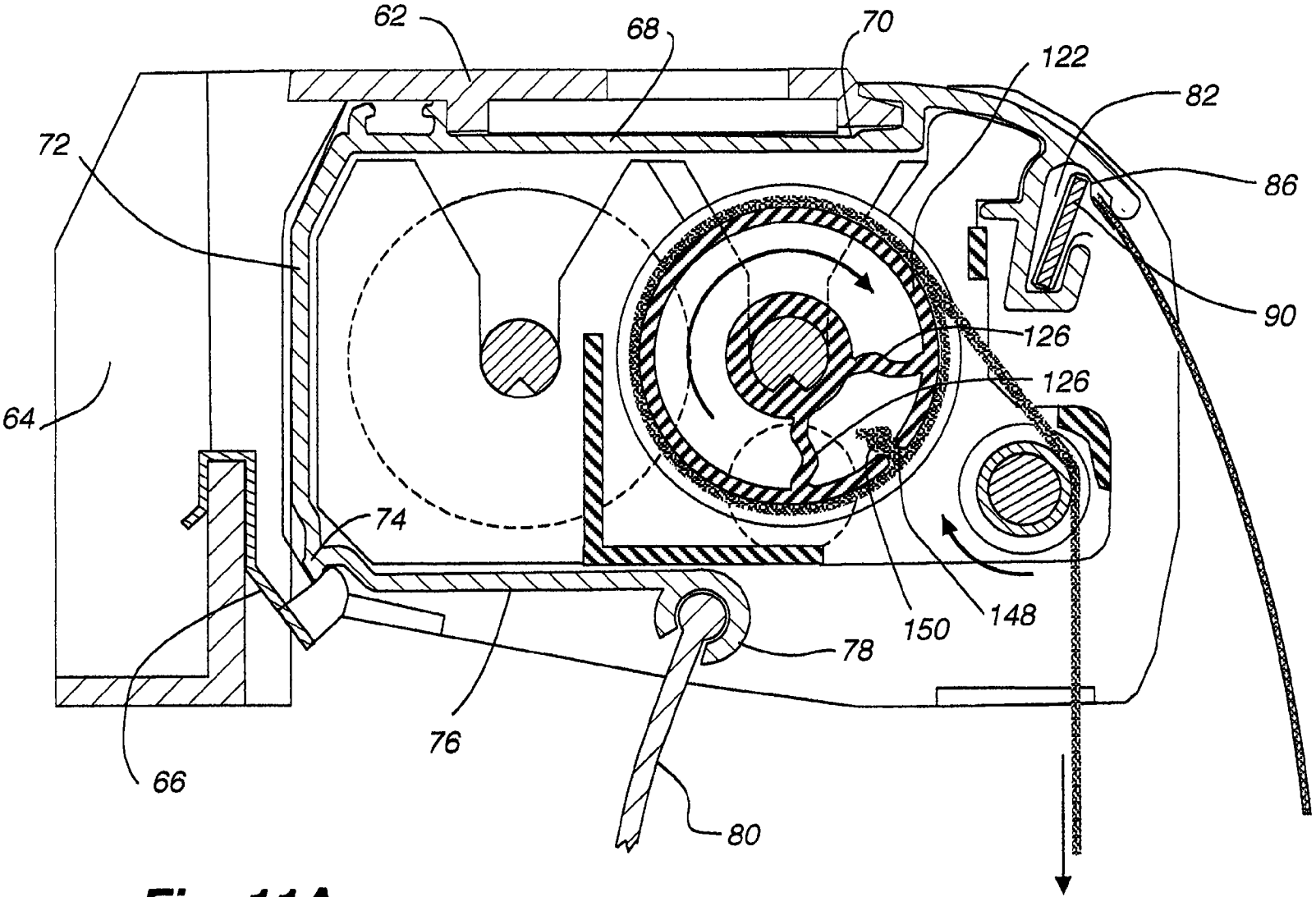
FIG. 11A is an enlarged section taken along line 11A-11A of FIG. 4.

The head rail 32 is mounted to the framework 58 (FIG. 2) of the architectural opening in which the covering is mounted with a pair of mounting brackets 60 shown best in FIGS. 9, 10 and 11A. The mounting brackets are identical and are of generally inverted L-shaped configuration so as to define a top overhang 62 and a vertical back wall 64 with the vertical back wall having a resilient forwardly extending spring biased catch leg 66 that is inclined downwardly and forwardly. The bracket is adapted to releasably receive the head rail 32 which is probably best seen in cross section in FIG. 11A to be of a generally U-shaped cross section opening forwardly so as to define a top wall 68 with a recessed seat 70 formed in the upper surface thereof, a rear wall 72 having a catch lip 74 at the bottom edge thereof and a bottom wall 76 having a C-shaped groove 78 for receipt of a first or rear upper dummy vane 80 which covers some of the components of the head rail for aesthetic reasons.

The head rail 32 is snapped into the mounting brackets 60 by inserting the overhang 62 of the mounting bracket into the seat 70 in the top wall 68 of the head rail and pivoting the head rail in a clockwise direction as viewed in FIG. 11A until the catch lip 74 in the bottom edge of the rear wall 72 of the head rail depresses and is caught by the resilient catch leg 66 of the mounting bracket.

The head rail 32 also has a forwardly opening groove 82 at the front edge of its top wall 68 which is adapted to seat and retain a second upper front dummy vane 84 which again covers portions of the head rail for aesthetics. The upper edge of the second or front dummy vane has a flexible strip 86 inserted into the groove 82 near the front of the top wall of the head rail and retained therein with an anchor strip 90. As will be appreciated by FIGS. 25A through 25C, a gap is defined between the groove 82 in the top wall 68 of the head rail and the C-groove 78 in the bottom wall 76 of the head rail through which operative components of the control system can pass, but in addition, at spaced locations along the length of the head rail, as illustrated for example in FIG. 3A, abutment stop arms 94 are mounted. Each abutment stop is of generally inverted V-shaped configuration having one leg 96 spanning the gap between the front edge of the top wall of the head rail and the front edge of the bottom wall of the head rail and having grooves 98 therein for retaining the abutment stops at the location where they are positioned on the head rail. The second leg 100 of each abutment stop extends vertically downwardly having a downwardly concave seat 102 on its bottom edge adapted to be abutted by the middle rail 36 when the middle rail is fully retracted or raised as shown for example in FIG. 25A. It will be appreciated that both the front and rear upper dummy vanes 84 and 80 respectively, are long enough to cover the vertical leg 100 of the abutment stops for aesthetic purposes.

As will be described hereafter, the drive shafts 48*a* and 48*b*, spools 46*a* and 46*b* and identical braking systems 52 associated with each of the bottom 34 and middle 36 rails of the covering are mounted within the head rail and therefore confined from view by the walls of the head rail itself in addition to the front and rear upper dummy vanes.

Figure 3A:
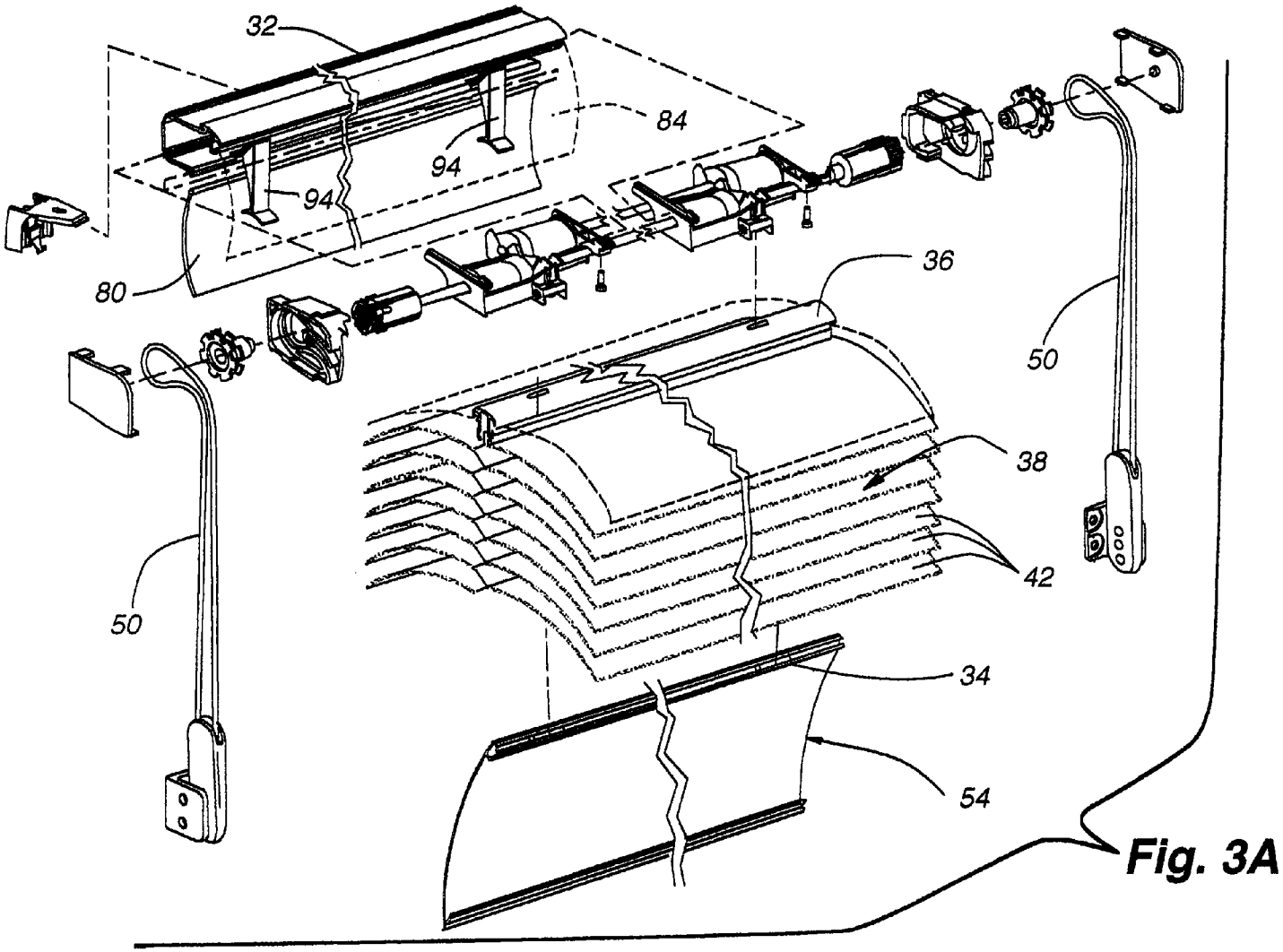
FIG. 3A is an exploded fragmentary isometric showing the covering of FIG. 1 in a partially retracted position.

Referring to FIG. 3A, the component parts of the control system that are housed in the head rail 32 are shown exploded. It will be better appreciated with the description that follows that the control system associated with the bottom rail 34 is the mirror image of the control system associated with the middle rail 36 with the systems being mounted in tandem within the head rail and each operated by its control element 50 with the control element for the bottom rail being at one end of the head rail and the control element for the middle rail being at the opposite end of the head rail.

For purposes of disclosure, the control system associated with the bottom rail 34 will be described in detail with it being understood the control system for the middle rail is identical and a mirror image except where specific differences are identified and accordingly, where applicable, like parts have been given like or similar reference numerals.

In the covering 30 described, there are only one pair of lift cords 44*b* being associated with the bottom rail 34 and one pair of lift cords 44*a* being associated with the middle rail 36 even though if the shade material 38, were longer in dimension, more lift cords could be provided as necessary and the addition of such lift cords would be apparent from the description that follows to one skilled in the art.

Figure 3B:
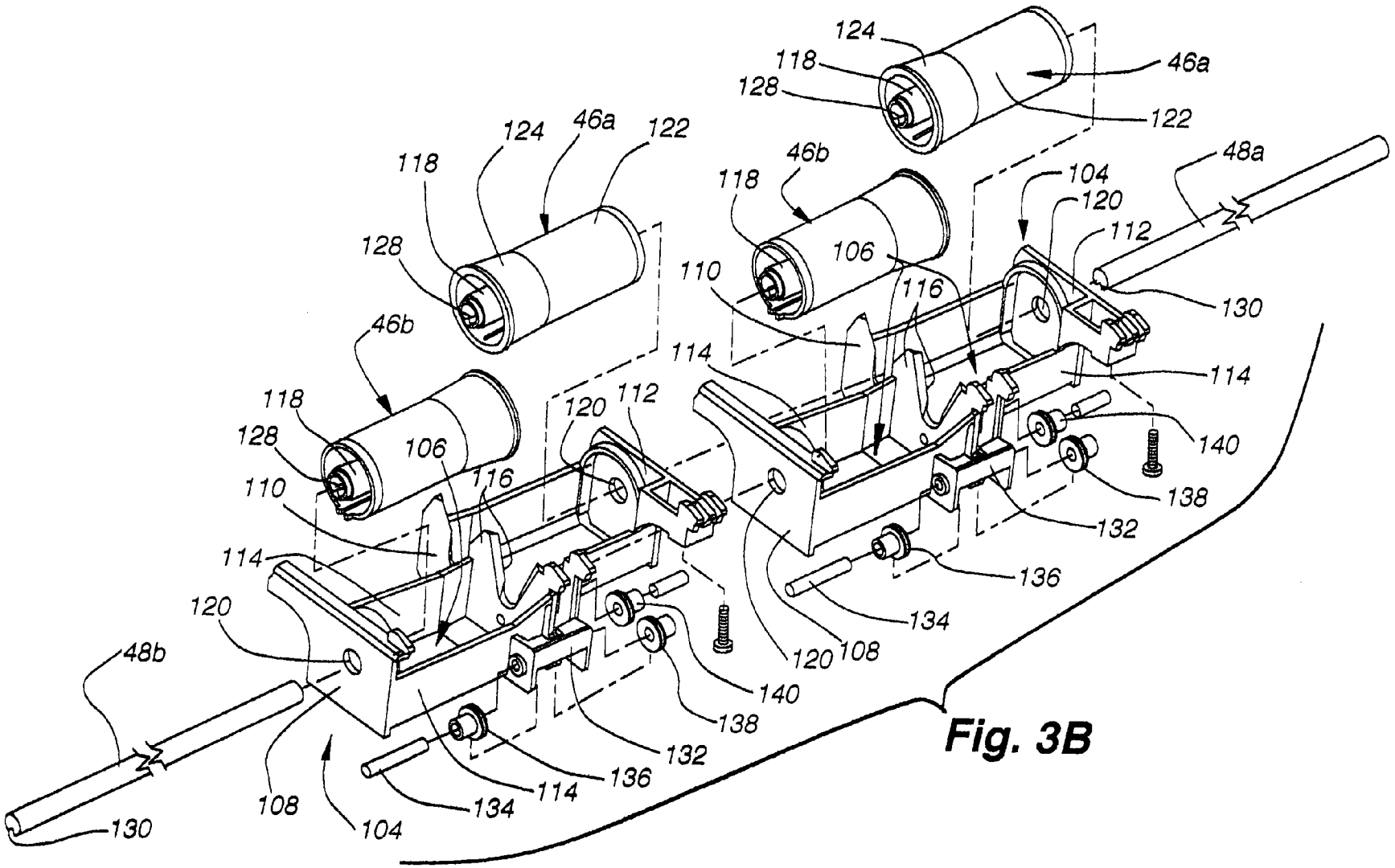
FIG. 3B is an exploded isometric showing components of the control system which are positioned the head rail.

Looking at FIG. 3B, a pair of identical cradles 104 are mounted in the head rail 32 in a manner to be described hereafter with each cradle having a pair of seats 106 to rotatably support a spool 46*a* or 46*b* from each pair of spools with the seats being longitudinally as well as laterally offset from each other. Each cradle therefore has a left end wall 108, a center wall 110 and a right end wall 112, as viewed in FIG.

3B, as well as longitudinally extending lateral walls 114 interconnecting the end walls with the middle wall. The middle wall also has side-by-side generally V-shaped notches 116 opening upwardly in axial alignment with each seat 106 to receive and serve as a bearing for one end of a support shaft 118 of a spool while each end wall 108 and 112 has a circular passage 120 that serves as a bearing for the opposite end of the support shaft 118 so that the spools are rotatably supported within their associated seats by support shafts which will be described hereafter.

Each spool 46*a* or 46*b* (FIGS. 3B and 11A) has an outer generally cylindrical wall 122 with a frustoconical tapered end 124 which in combination define a wrap surface for a lift cord 44*a* or 44*b*. The spools also have internal ribbing 126, as possibly seen best in FIGS. 4 and 11A, that support the internal support shaft 118 of the spool in co-axial relationship with the cylindrical wall 122. The support shaft 118 is hollow defining a generally cylindrical axial passageway with a longitudinally extending V-shaped bead 128 which corresponds with a V-shaped groove 130 in the generally cylindrical drive shaft 48*a* or 48*b* as possibly best seen in FIG. 3B. Accordingly, when a drive shaft is extended through the support shafts of the spools, the groove 130 in the drive shaft is aligned with the bead 128 in the spool so they are keyed together and rotate in unison. Obviously, one drive shaft 48*a* extends through one of the seats 106 in a cradle 104 while the other drive shaft 48*b* extends through the other seat in the cradle and as will be appreciated, the spool 46*b* in one seat of a cradle is associated with the bottom rail 34 while the spool 46*a* in the other seat of a cradle is associated with the middle rail 36.

With reference to FIGS. 3B, 17 and 21-24, the cradle 104 can also be seen to have a bracket 132 off the front thereof which is centered and supports at the front thereof a longitudinally extending pivot pin 134 on which are rotatably mounted a pair of pulleys 136 and 138. One pulley 136 is aligned with the tapered end of one spool 46*b* in the cradle and the other pulley 138 is aligned with the tapered end of the other spool 46*a* in the cradle. A third pulley 140 is mounted on the bracket 132 and spaced rearwardly from the pulley 138 at the front of the bracket with the third pulley not only being aligned with its associated pulley 138 at the front of the bracket, but also with the tapered surface of the rearmost spool 46*a* in the cradle. As will be appreciated with the description that follows, the pulleys are adapted to maintain alignment of the lift cords between their associated spools and the associated bottom 34 or middle 36 rails while also providing a smooth transition of the lift cords 44*a* and 44*b* as the rails are raised or lowered. The operation of the pulleys in association with the spools and the rails will be better appreciated with a description of the operation of the control system hereinafter.

Figure 17:
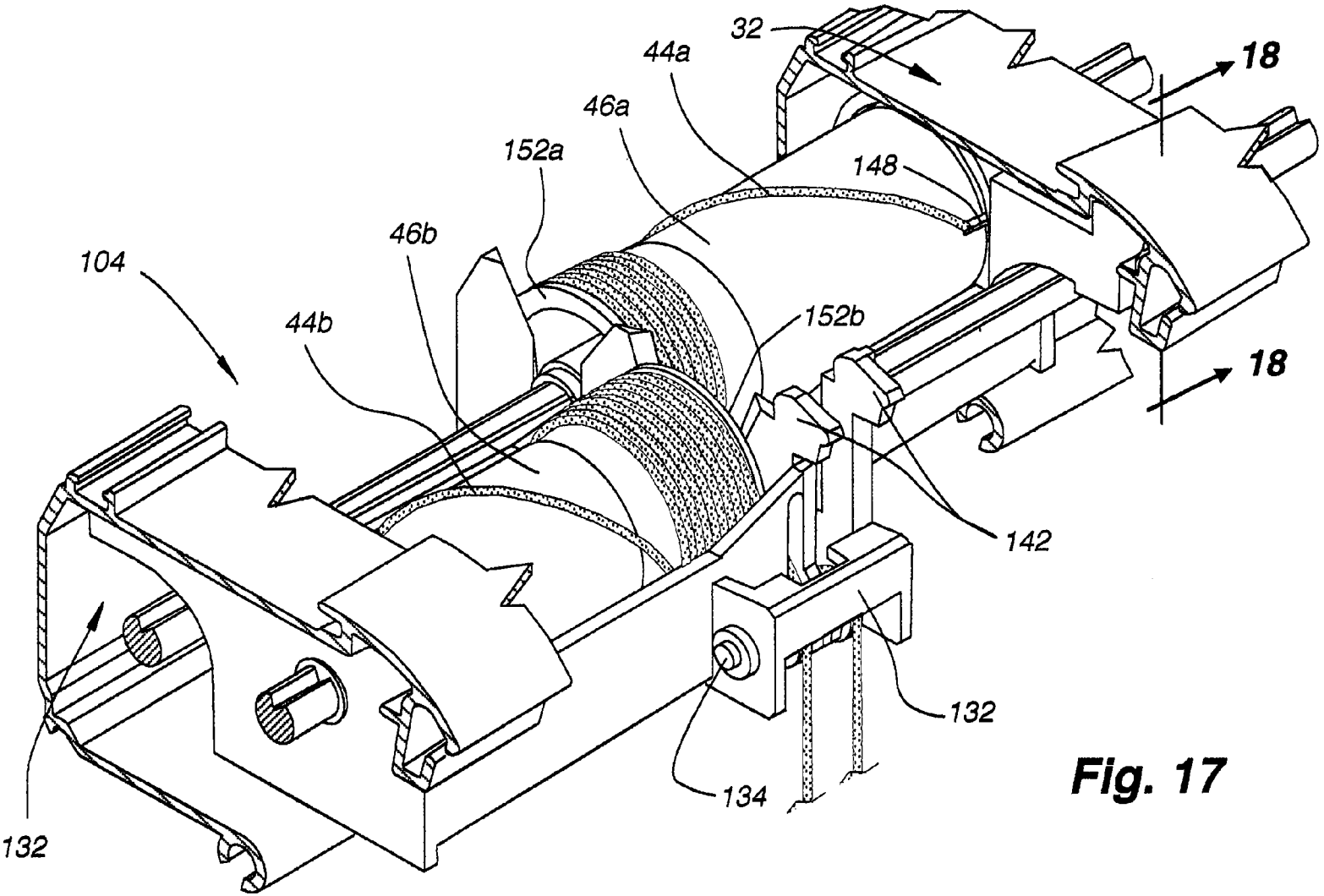
FIG. 17 is a fragmentary isometric looking at the portion of the control system wherein the drive shafts are associated with a spool and with lift cords wrapped around the spools.
Figure 18:
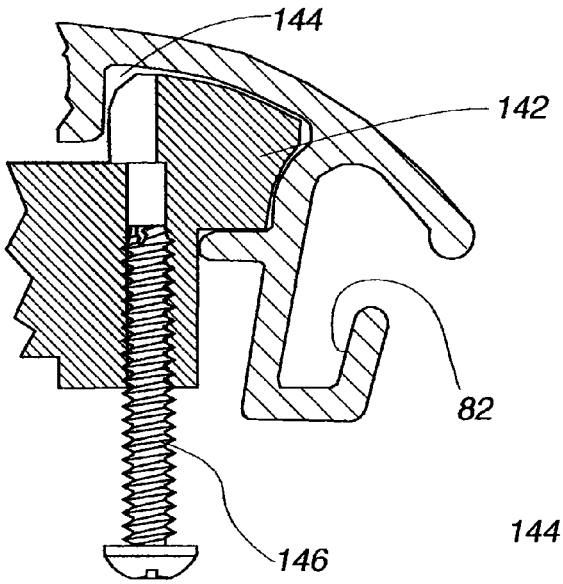
FIG. 18 is an enlarged section taken along line 18-18 of FIG. 17.
Figure 19:
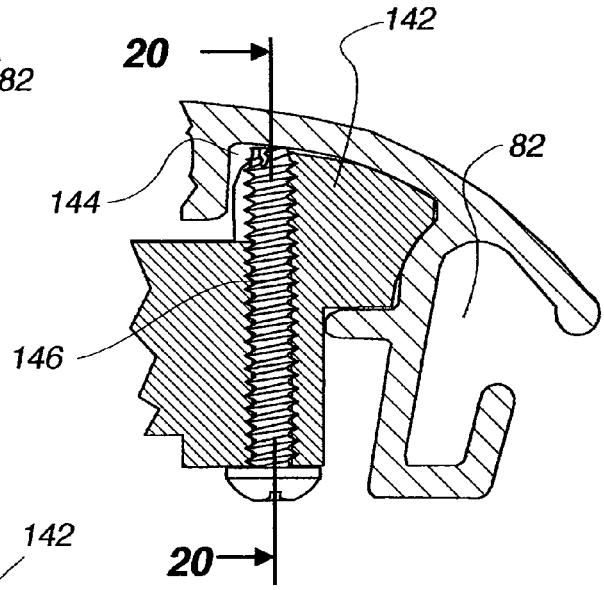
FIG. 19 is a section similar to FIG. 18 with the threaded fastener in a locking position to secure the head rail to a cradle.
Figure 20:
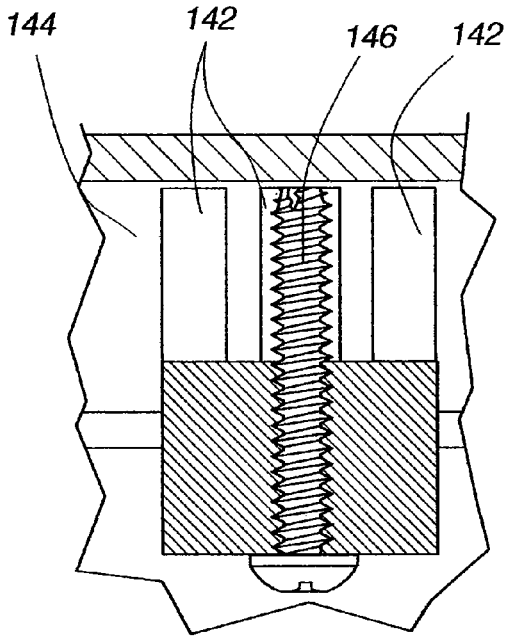
FIG. 20 is a section taken along line 20-20 of FIG. 19.
Figures 21, 22, 23, 24:
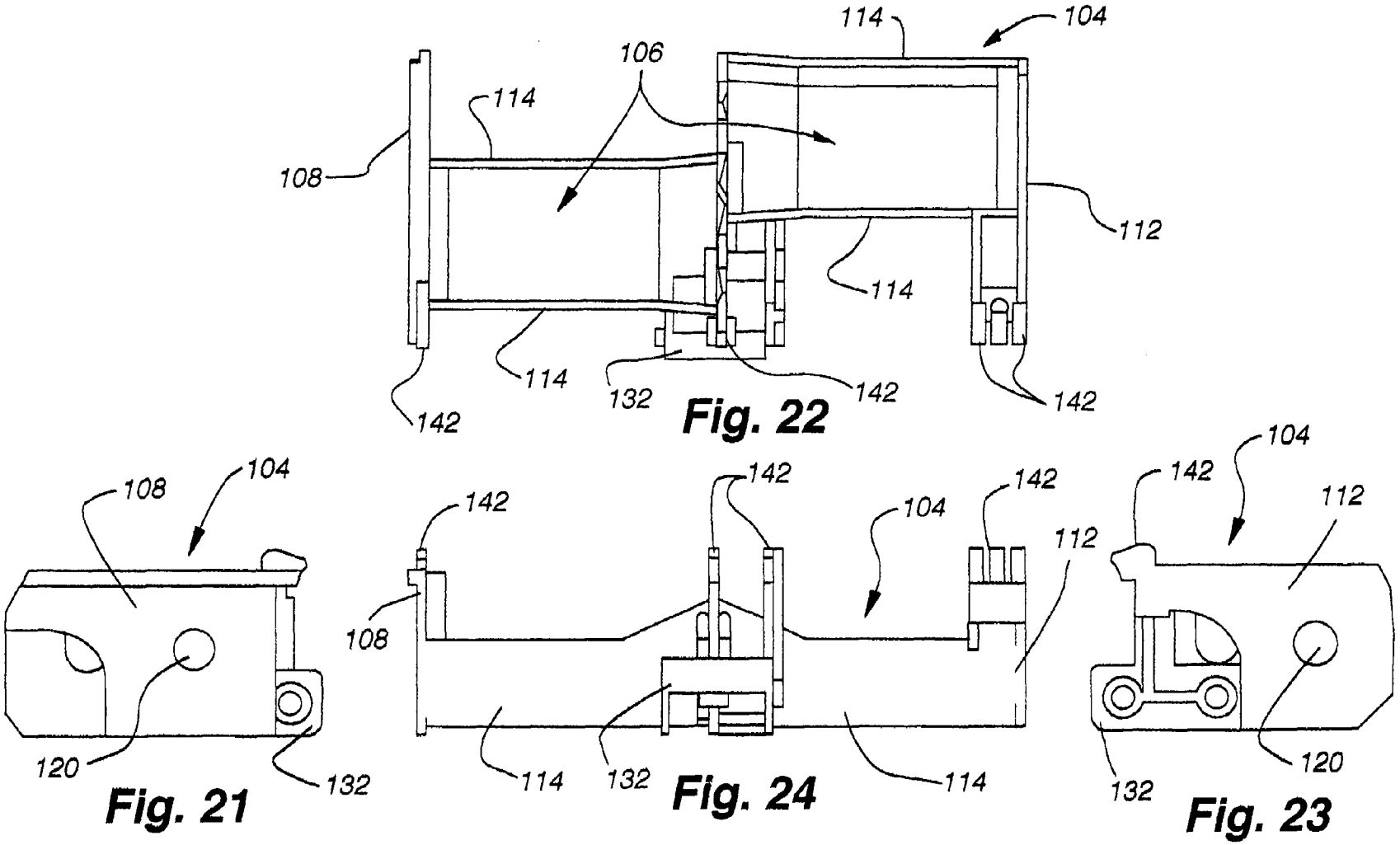
FIG. 21 is a left-end elevation of a cradle for rotatably seating two of the lift cord spools.
FIG. 22 is a top plan view of the cradle.
FIG. 23 is a right-end elevation of the cradle.
FIG. 24 is a front elevation of the cradle.

As is possibly seen best in FIGS. 3B and 17, each cradle 104 also has a plurality of catch fingers 142 along its front upper edge with the left end of the cradle as viewed in FIG. 3B, for example, having one such finger, the middle wall having two spaced fingers and the right end wall having three fingers. These fingers are adapted to be seated as best seen in FIGS. 18-20 in an internal groove 144 provided in the undersurface of the top wall 68 of the head rail adjacent its front edge. Once the fingers have been positioned in the internal groove of the head rail, a threaded bolt type fastener 146 (FIGS. 18-20) can be advanced through a threaded hole in some of the fingers until it engages the bottom surface of the top wall 68 of the head rail thereby preventing the fingers from being removed from the groove in the head rail and securing the cradle to the head rail.

As is possibly best appreciated by reference to FIG. 17, each spool 46*a* or 46*b* at its non-tapered end has a longitudinal slot 148 formed in the outer cylindrical wall 122 for anchoring one end of the lift cord associated with that spool. The end of the lift cord can be knotted for example at 150 (FIG. 11A) and positioned internally of the spool so that the lift cord can then be spirally wrapped around the outer surface of the spool toward the tapered end 124. The tapered end of each spool is aligned with the aforenoted pulleys in the routing of the lift cords to the associated bottom 34 or middle 36 rail.

During operation of the control system, as the lift cord is wound onto an associated spool 46*a* or 46*b*, it is fed tangentially to the tapered end of the spool against a disc 152*a* or 152*b* respectively (FIG. 17) formed on the end of the spool so that each wrap of cord is forced axially down the tapered outer wall 124 of the spool toward the opposite end of the spool by a subsequent wrap. Of course, when the lift cords are removed from the spool, they are removed from the tapered end of the spool and the remaining cords are simply pulled toward that end as the spool is rotating with its associated drive shaft.

As mentioned previously, each drive shaft 48*a* and 48*b* is associated with a brake system 52 in the form of a double-acting clutch with the brake system being mounted at an end of the head rail 32 and in direct association with an endless control element 50 which is manually operated by the operator of the covering. Looking at FIG. 3C, the components of the brake system and its association with a control element is illustrated. FIG. 3D is a view of the same elements from a different direction for purposes of clarity. Looking first at FIG. 3C, at the left end is an end cap 154 adapted to be snap fitted over the outer face of a support plate 156 to confine a drive wheel 158 in a rotatably seated relationship with the support plate. The brake system is snap fitted onto the opposite face of the support plate and includes an inner housing 160 that slidably fits within an outer housing 162 so as to rotatably confine therein and there between a dual tanged coil spring 164, a drive element 166 and a driven element 168. The inner housing member has a pair of diametrically opposed bosses 170 with cylindrical passages therethrough which can be aligned with threaded holes in bosses 172 provided on the outer housing element. The inner and outer housing elements can therefore be connected with fasteners 174 to confine the coil spring, driven element and drive element within a generally cylindrical cavity defined between the inner and outer housing elements. The inner element also has a pair of longitudinal ribs 176 on its outer surface adapted to fit within corresponding longitudinal recesses 178 in the outer element to facilitate alignment of the two housing elements.

The outer housing element 112 has an open end 180 for receipt of the inner housing element 160 and a closed opposite end (FIG. 3D) having a cylindrical passage 182 therethrough. The inner housing element has an open end 184 that abuts the support plate 156 and a partially closed opposite end (FIG. 3D) for abutment with a disc-like end plate 186 on the drive element 166 of the clutch spring. In other words, the partially closed end of the inner housing element defines a peripheral abutment wall 188 against which the disc-like end plate 186 of the drive element can rotate. One side of the disc-like end plate of the drive element has a square stub shaft 190 that is inserted into the hollow interior of the inner housing element 160 and the opposite side of the end plate has an arcuate plate-like extension 192 which is adapted to be inserted within the interior of the coil spring 164. The driven element 168 also has a disc-like plate 194 but has a cylindrical shaft 196 projecting toward the outer housing member 162 with the cylindrical shaft having an opening 198 in its outer end for receipt of a drive shaft 48*a* or 48*b*. The opening 198 is keyed to receive the drive shaft or the drive shaft can be otherwise secured therein as with adhesive or the like. The opposite face of the disc-like plate 194 of the driven element has an axial block 200 formed thereon with a somewhat cylindrical main body 202 having an arcuate portion 204 with the entire block being insertable into the opposite end of the coil spring 164. As can be appreciated by reference to FIG. 6, the arcuate portion 204 on the driven element is circumferentially spaced from the arcuate extension 192 on the drive element when they are confined within the coil spring and the tangs 206 and 208 at opposite ends of the coil spring are positioned in the space between the arcuate extension and the arcuate portion.

When the drive 166 and driven 168 elements as well as the coil spring 164 are confined within the inner 160 and outer 162 housing members and the inner and outer housing members are connected together, the entire brake system 52 is advanced against the end of the support plate 156 so that a pair of radially projecting fingers 210 on the end of the inner housing member engage and deflect catch arms 212 (FIG. 3D) on the support plate so as to releasably connect the brake system to the support plate in alignment with a circular passage 214 through the support plate. As mentioned previously, the square stub shaft 190 on the drive element 166 projects into the cylindrical cavity in the inner housing member and is therefore exposed within the cylindrical cavity (FIG. 4).

Figure 7:
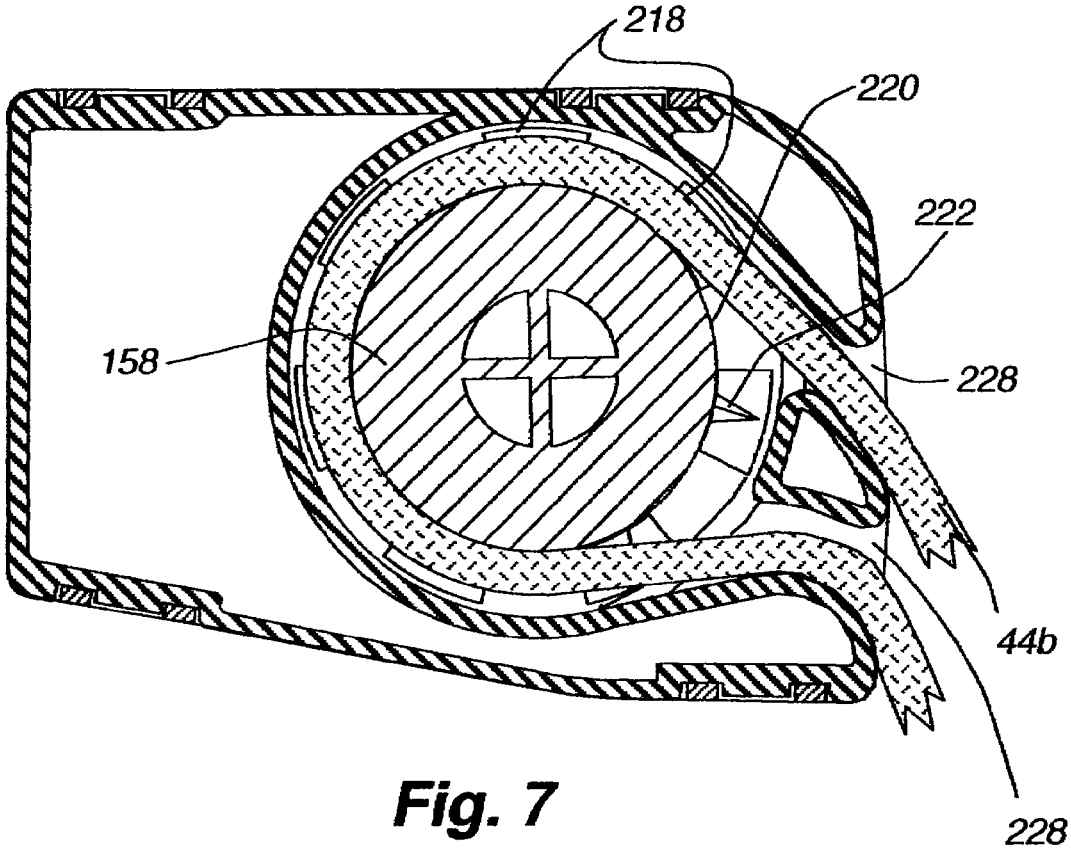
FIG. 7 is an enlarged section taken along line 7-7 of FIG. 4.
Figure 8:
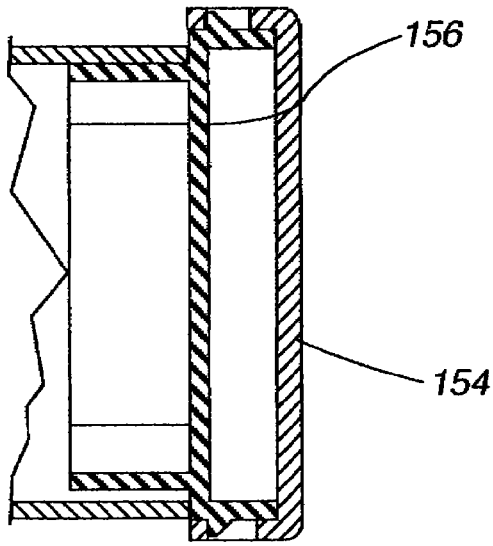
FIG. 8 is a section taken along line 8-8 of FIG. 6.

The drive wheel 158 which is driven by an endless control element 50 has a pair of spaced circumferential elements 216 with radiating fingers 218 that define therebetween a peripheral narrow cylindrical surface 220 having circumferentially spaced barbs 222 for engagement with the control element which is typically a cord into which the barbs will project to provide positive gripping. Accordingly, when the endless cord is rotated, the drive wheel is also rotated for operating the control system. The drive wheel has a cylindrical shaft 224 projecting toward the brake system 52 with a square recess 226 (FIG. 3D) in the end of the shaft adapted to mate with and receive the stub shaft on the drive element of the spring clutch. Accordingly, with the brake system mounted on the support plate 156 when the drive wheel is inserted into the support plate, the square recess in the end of the drive wheel shaft will mate with the square stub shaft in the cylindrical cavity of the inner housing member. The inner housing member 160 thereby serves as a bearing surface for the shaft 224 of the drive wheel. The circular passage 214 through the support plate also defines a support surface for the drive wheel so that the barbed narrow cylindrical surface 220 is aligned with a pair of slots 228 opening through the support plate (FIG. 3C) on a front edge thereof. The slots are adapted to slidably receive the endless control element so that after it passes around the barbed drive wheel, it extends outwardly and hangs down in a loop adjacent one end of the head rail 32 for manual manipulation by an operator. This is probably best appreciated by reference to FIG. 7.

As will be appreciated from the above, each drive shaft 48*a* and 48*b* has one end inserted into and supported by the driven element 168 of the clutch spring and extends horizontally along the head rail 32 in tandem with the other drive shaft. Each drive shaft extends through one spool 46*a* or 46*b* in each cradle 104 and is thereby supported by its associated spools. As mentioned previously, the spools are keyed to the drive shafts so they rotate in unison therewith and as will be explained hereafter, each drive shaft also rotates in unison with its associated spring clutch 52 which functions as a braking system for retaining the drive shaft and consequently the spools mounted thereon in a fixed position when the drive shaft is not being rotated by a control element.

Figure 3C:
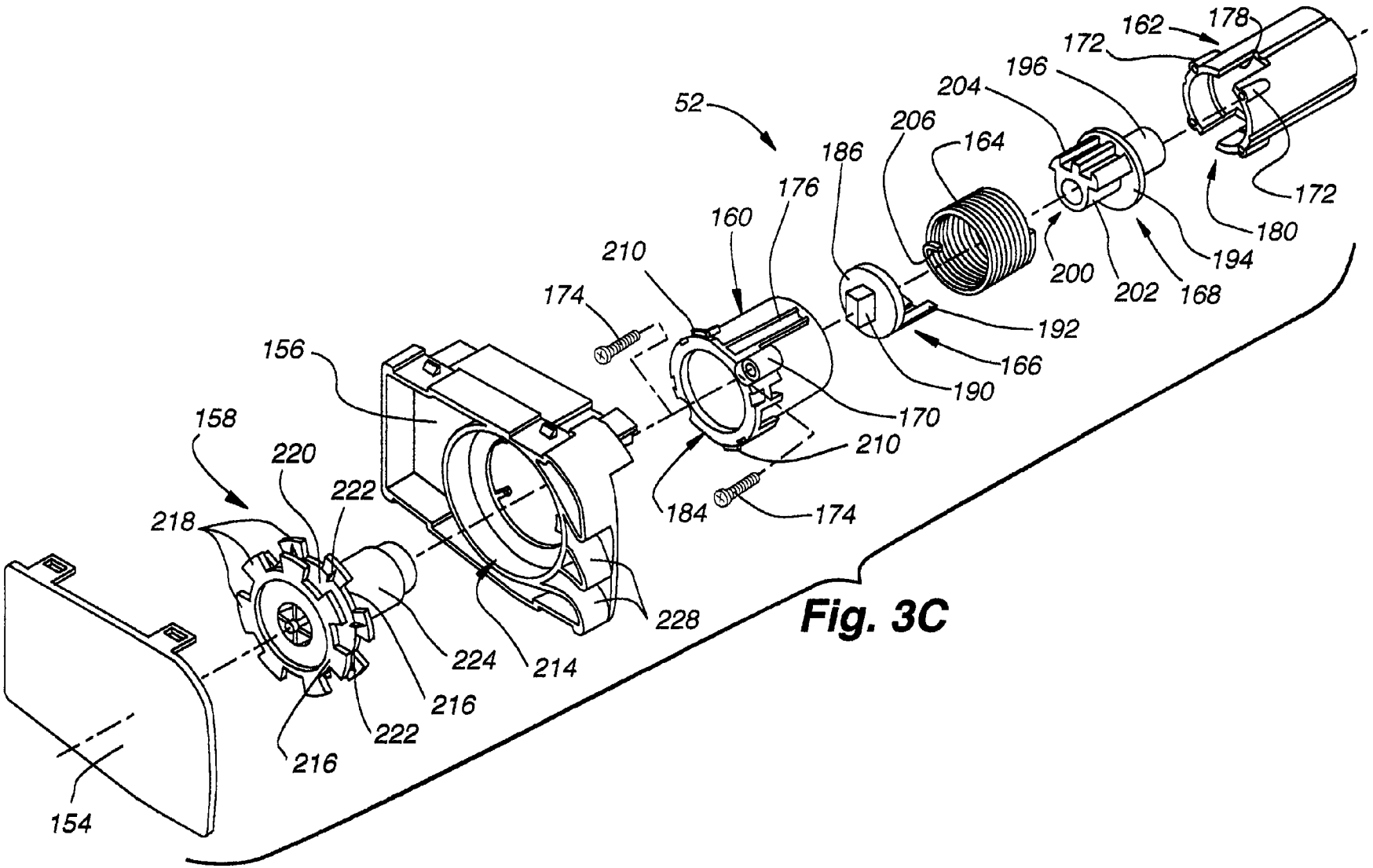
FIG. 3C is an exploded isometric similar to FIG. 3B showing other components of the control system within the head rail.
Figure 3D:
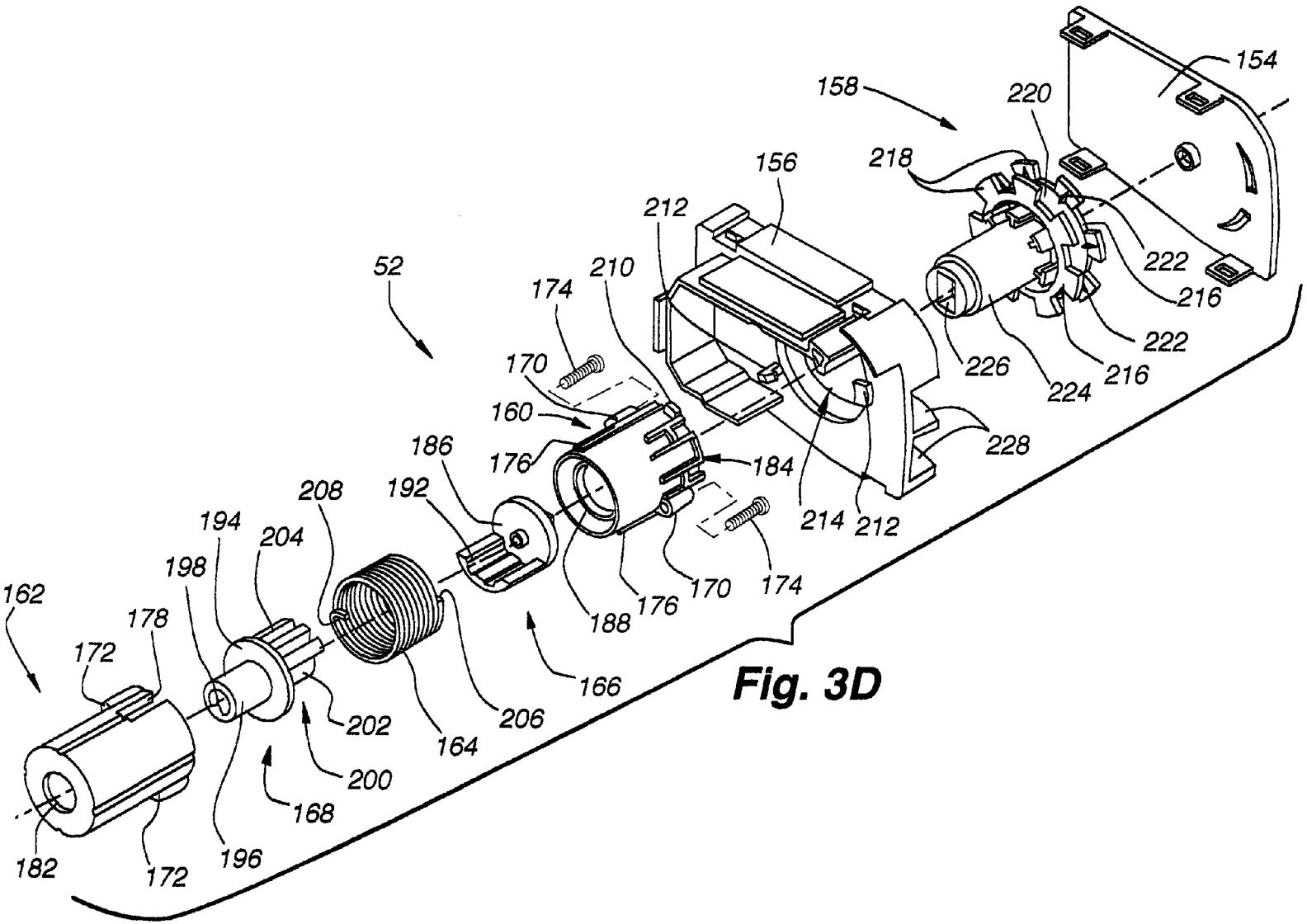
FIG. 3D an exploded isometric similar to FIG. 3C looking from a different direction.
Figure 4:
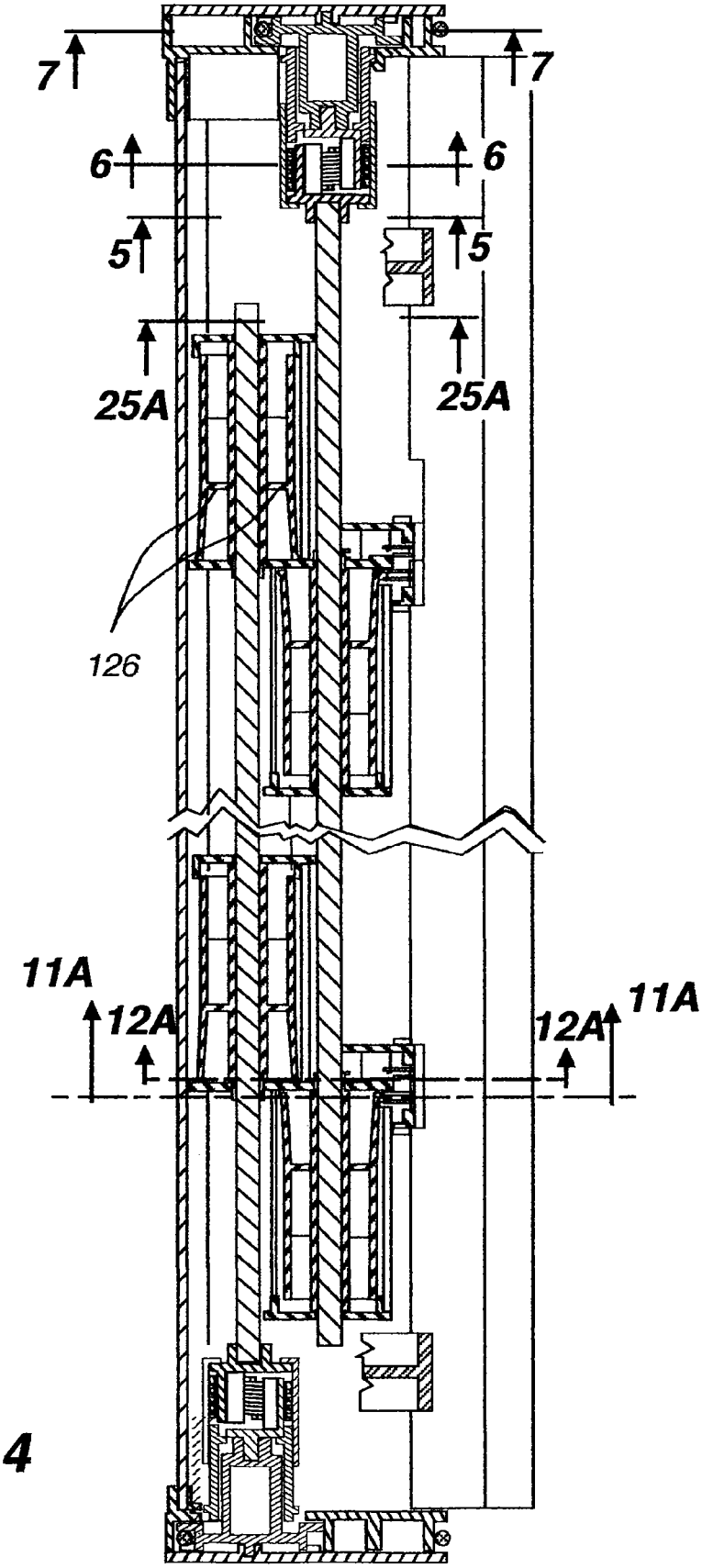
FIG. 4 is an enlarged section taken along line 4-4 of FIG. 2.
Figure 5:
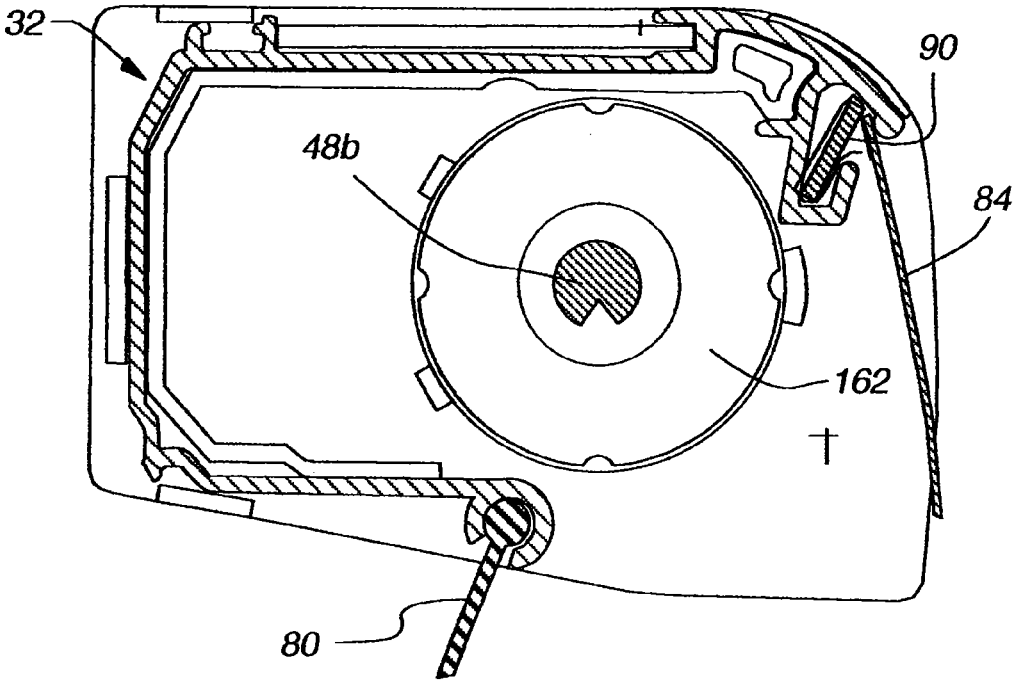
FIG. 5 is an enlarged section taken along line 5-5 of FIG. 4.
Figure 6:
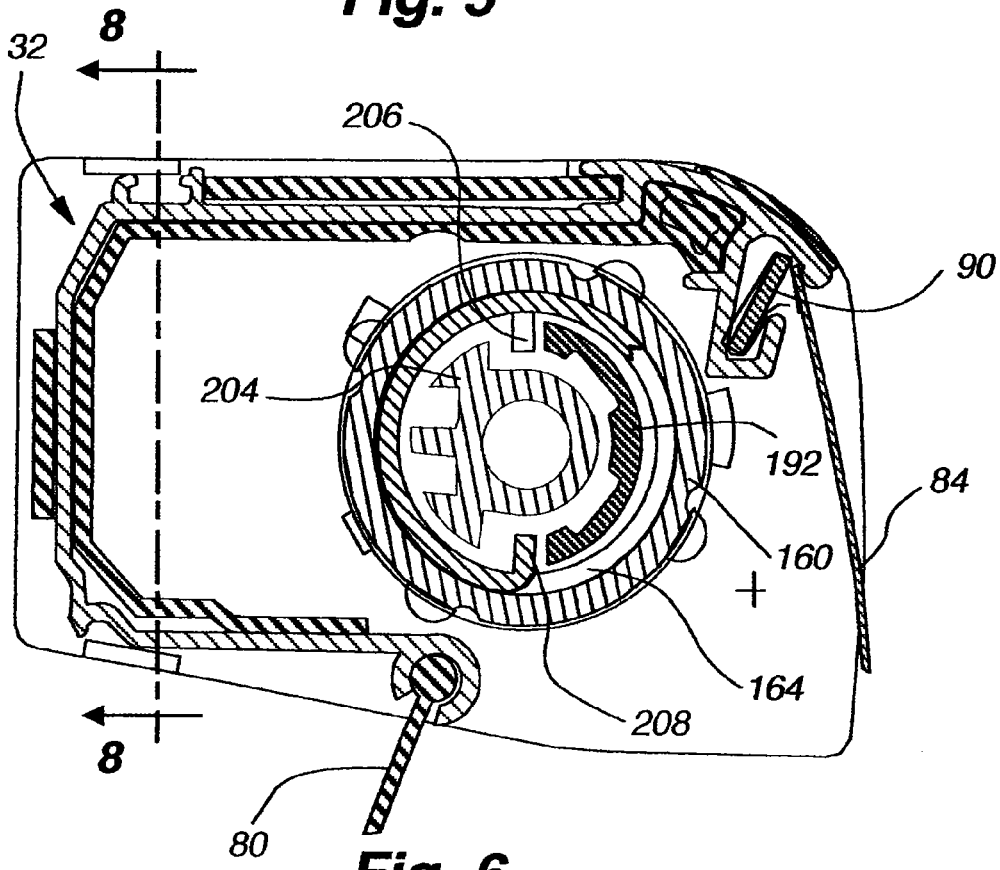
FIG. 6 is an enlarged section taken along line 6-6 of FIG. 4.

As best appreciated by reference to FIGS. 3C, 3D and 6, the coil spring 164 is sized to frictionally engage the interior cylindrical wall of the inner housing member 160 and of course its tangs 206 and 208 are positioned between the drive 166 and driven 168 members so as to normally prevent rotation of these members as well as the drive shaft 48*a* or 48*b* keyed to the driven member. Accordingly, if no force is being applied to a control element 50, the system is locked and an associated middle 36 or bottom 34 rail will remain fixed in its position within an architectural opening. However, if a control element 50 is pulled in one direction or another, the drive member will engage one of the tangs 206 or 208 thereby reducing the diameter of the coil spring, and releasing its frictional engagement with the inner housing member, as the drive member is being rotated to allow the operatively connected drive shaft to rotate and thus raise or lower the associated middle or bottom rail depending on the direction the drive member is being rotated by the control element.

Figure 11B:
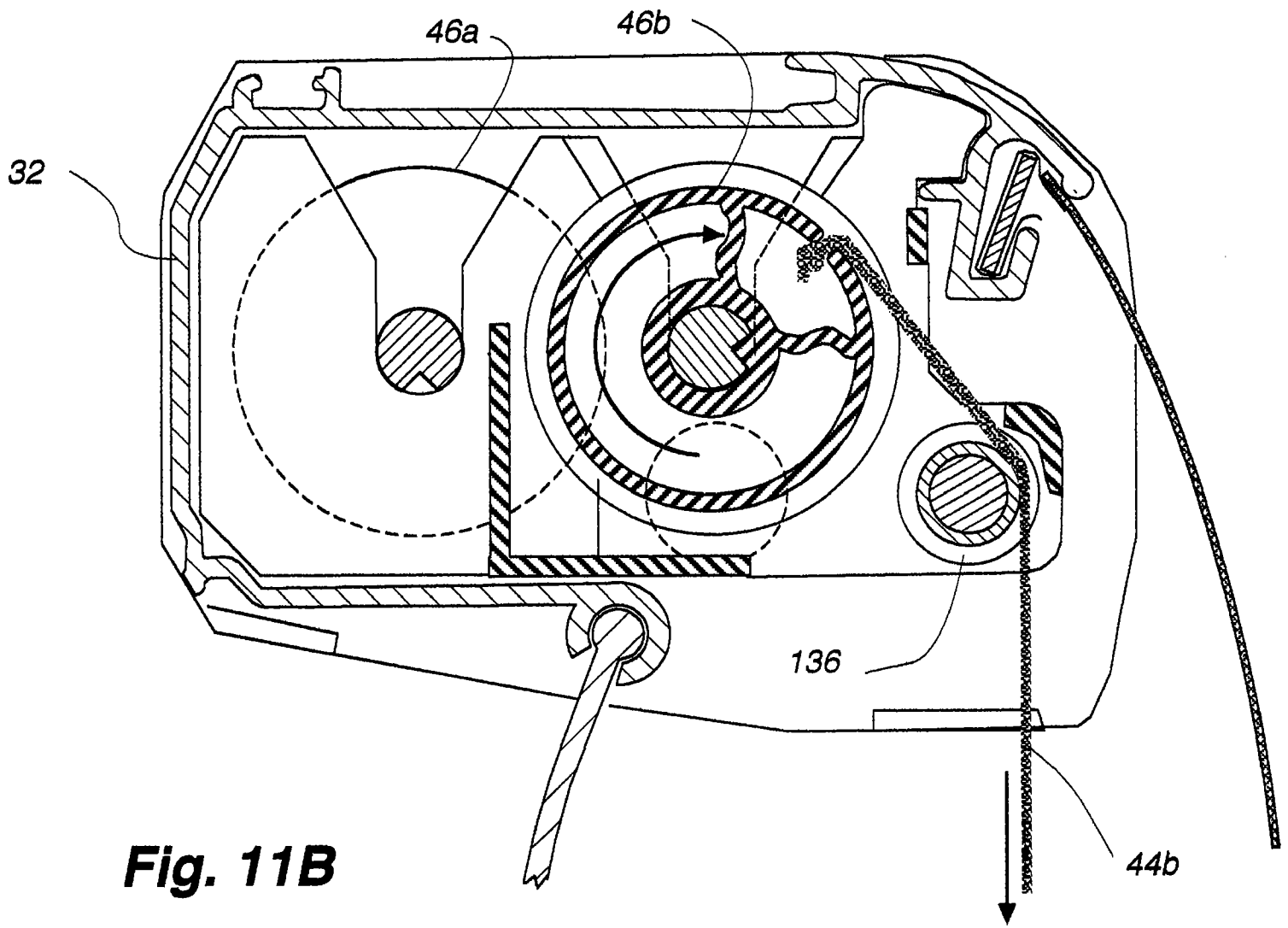
FIG. 11B is a section similar to FIG. 11A showing the lift cord and associated spool in a position wherein the spool has been rotated clockwise.
Figure 11C:
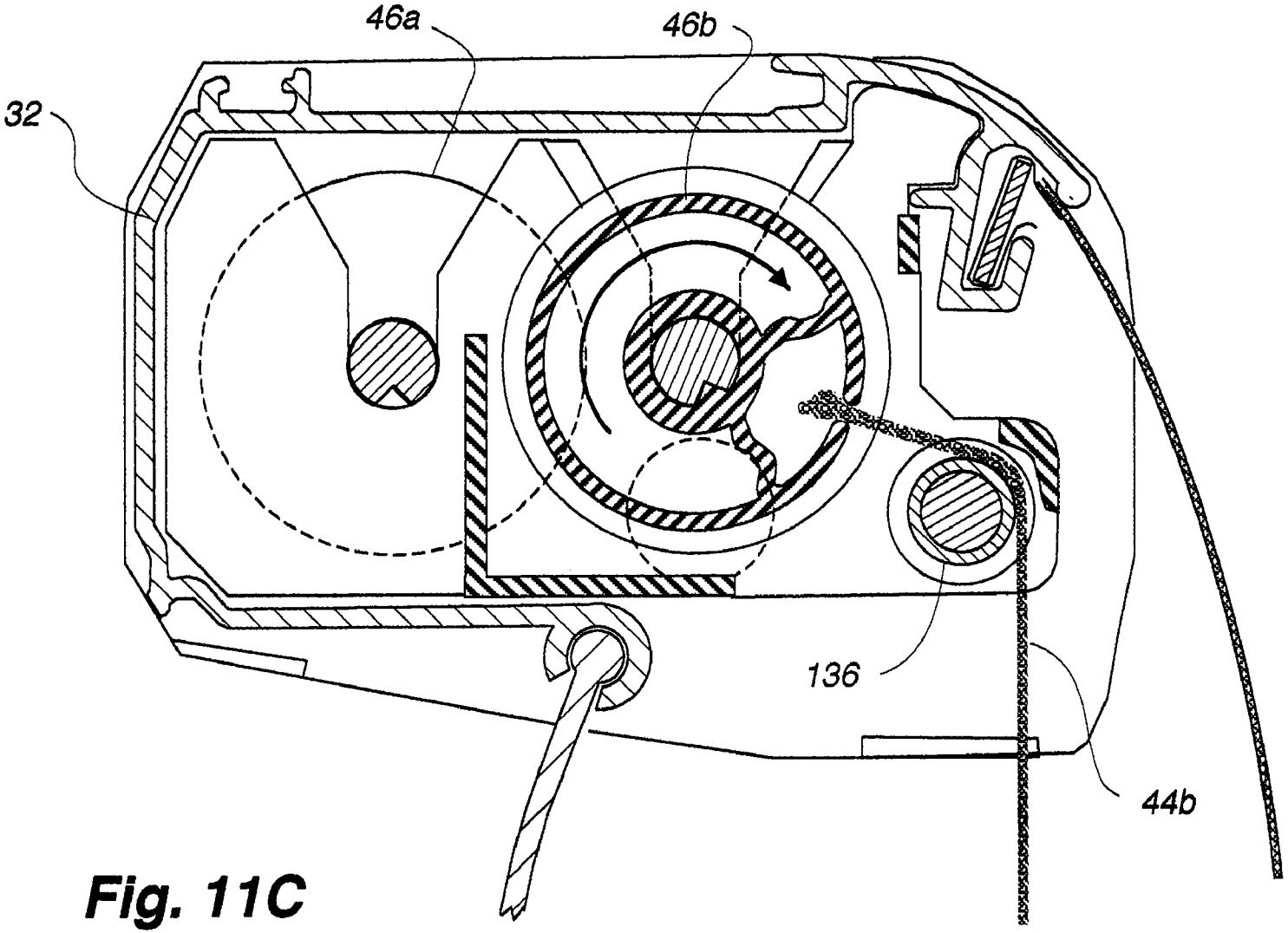
FIG. 11C is a section similar to FIG. 11B wherein the spool has been rotated slightly further in a clockwise direction.
Figure 11D:
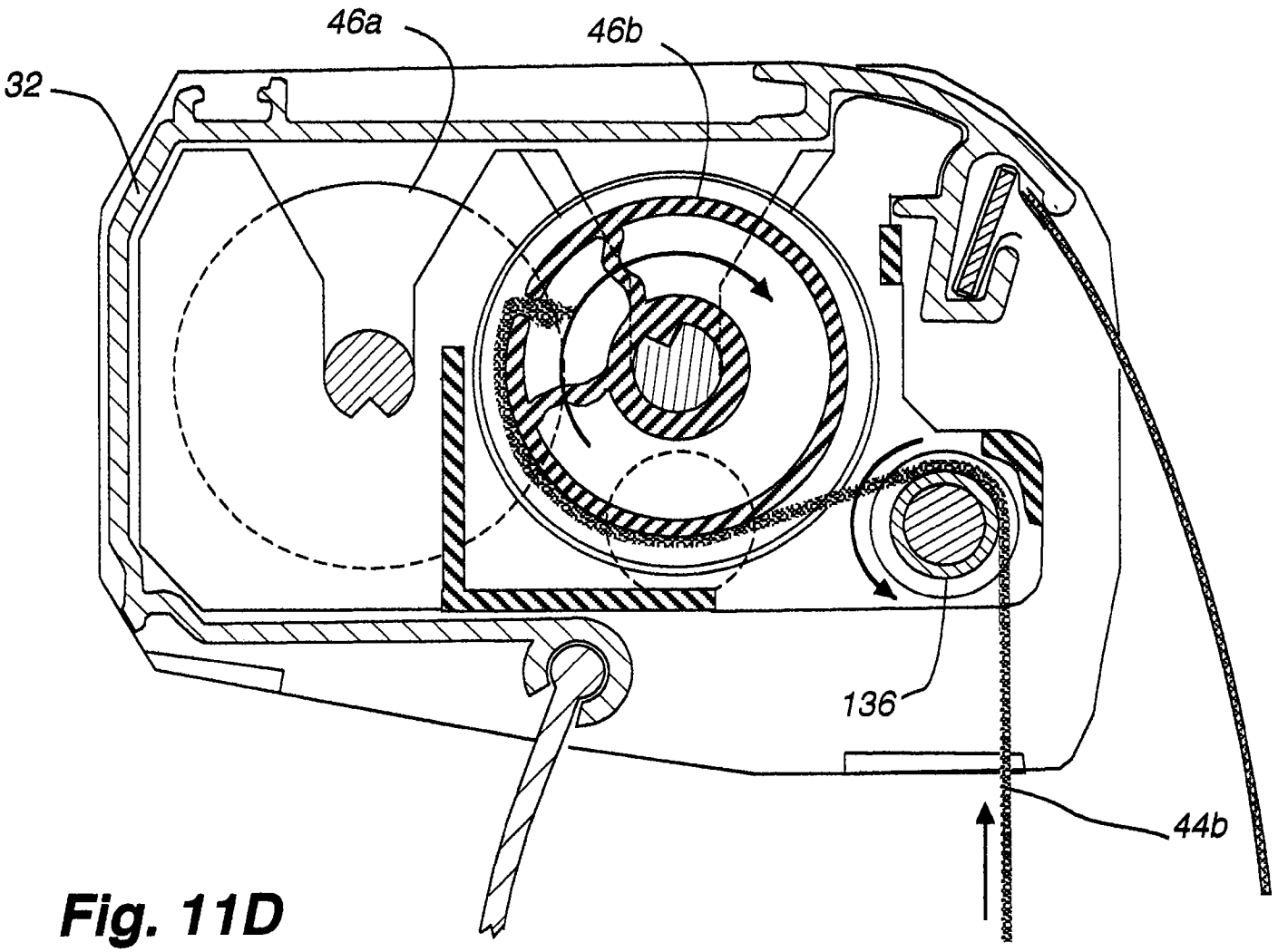
FIG. 11D is a section similar to FIG. 11B with the spool having been rotated even further in a clockwise direction.

The operation of the control system as it is associated with the bottom rail 34 of the covering is probably best appreciated by reference to FIGS. 11A through 11D. It will there be seen that the lift cords 44*b* associated with the spools 46*b* are anchored at one end to the non-tapered end 122 of the lift spool, as mentioned previously, and wound around the lift spool before subsequently passing around the pulley 136 at the front of a cradle and then downwardly to its attachment to the bottom rail. With reference to FIG. 11A, the cord is shown wound onto the spool while it is being unwound so that the bottom rail is being lowered. Once the lift cord has been substantially unwound from its spool as shown in FIG. 11B, the lift spool is continued to be rotated in a clockwise direction until the lift cord forms a straight line from its knotted end 150 to the pulley 136 and the knotted end of the lift cord is in close proximity to the pulley. Continued rotation of the lift spool in a clockwise direction causes the lift cord to wrap about the spool in an opposite direction. Rotation of the control cord in one direction can thereby lower the bottom rail totally until the lift cord and spool are positioned as shown in FIG. 11C. Rotation of the control element in either direction thereafter will raise the bottom rail. Of course the next time the covering is operated, the control element 50 would have to be moved in an appropriate direction to lower the bottom rail. It will be appreciated the control element does not necessarily have to be continuously rotated in one direction to extend and retract the covering as it could be extended by rotating the control element in one direction and then retracted by rotating it in the opposite direction.

Figure 12A:
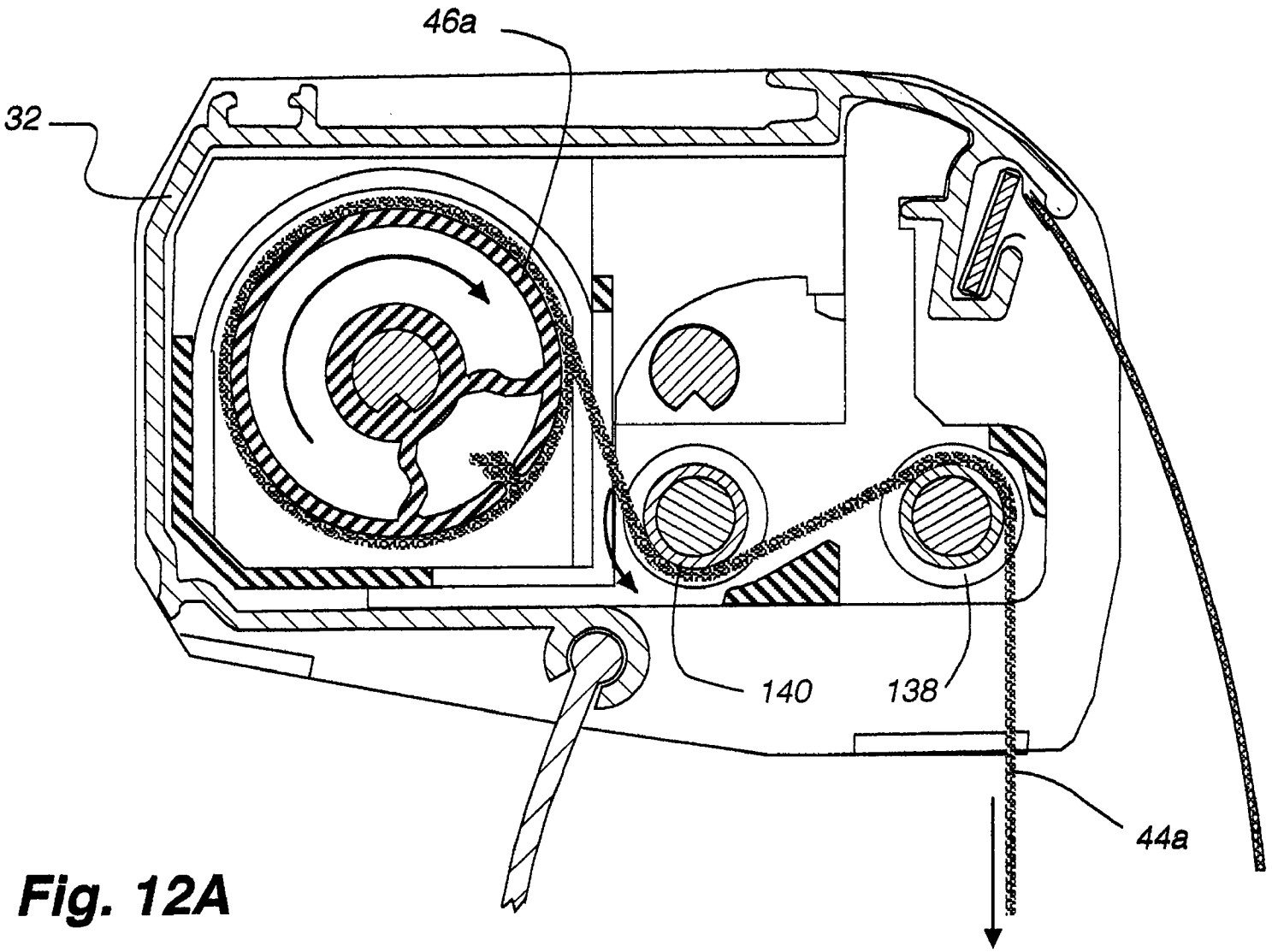
FIG. 12A is a section taken along line 12A-12A of FIG. 4.
Figure 12B:
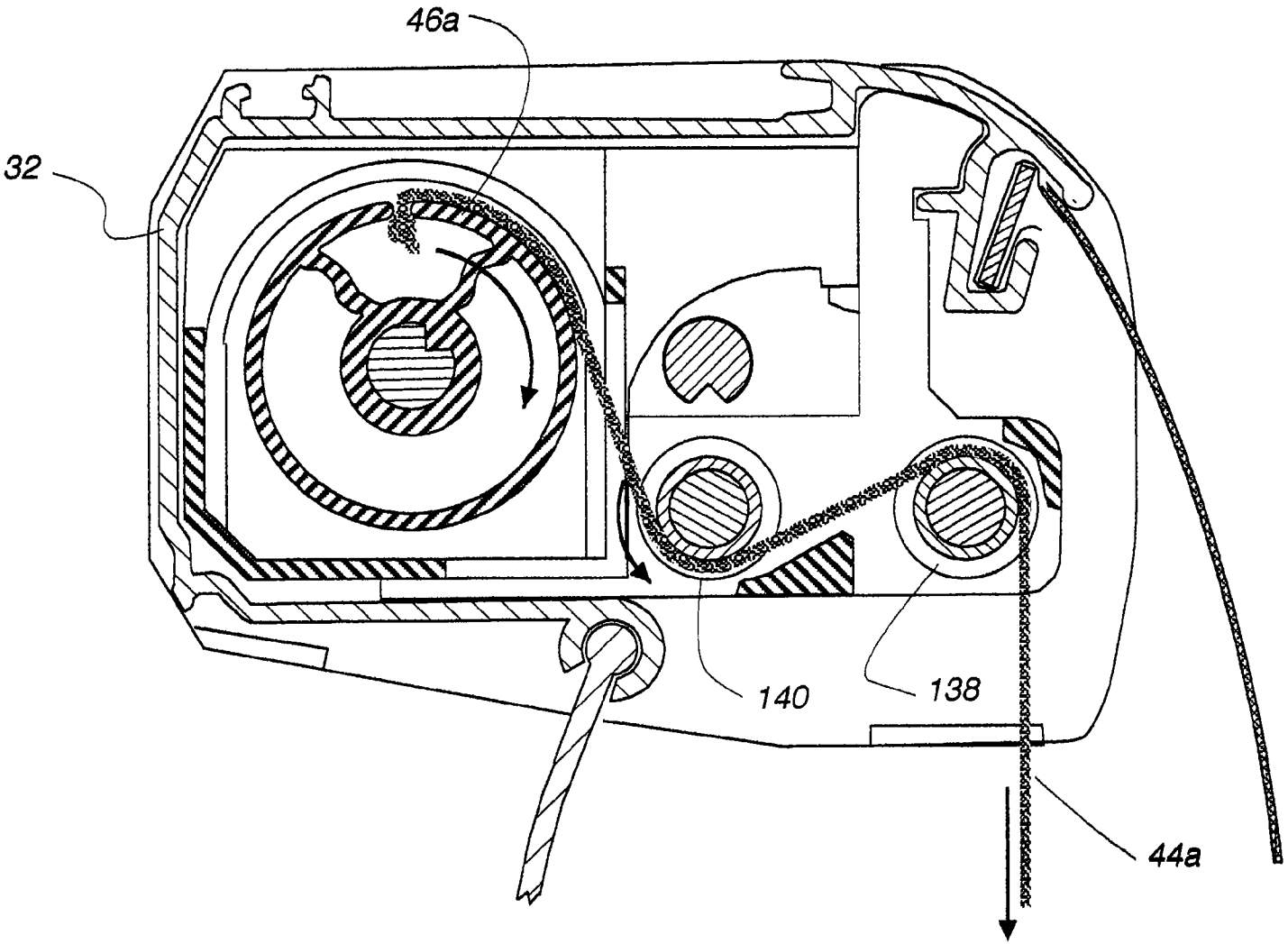
FIG. 12B is a section similar to FIG. 12A with a spool having been rotated in a clockwise direction.
Figure 12C:
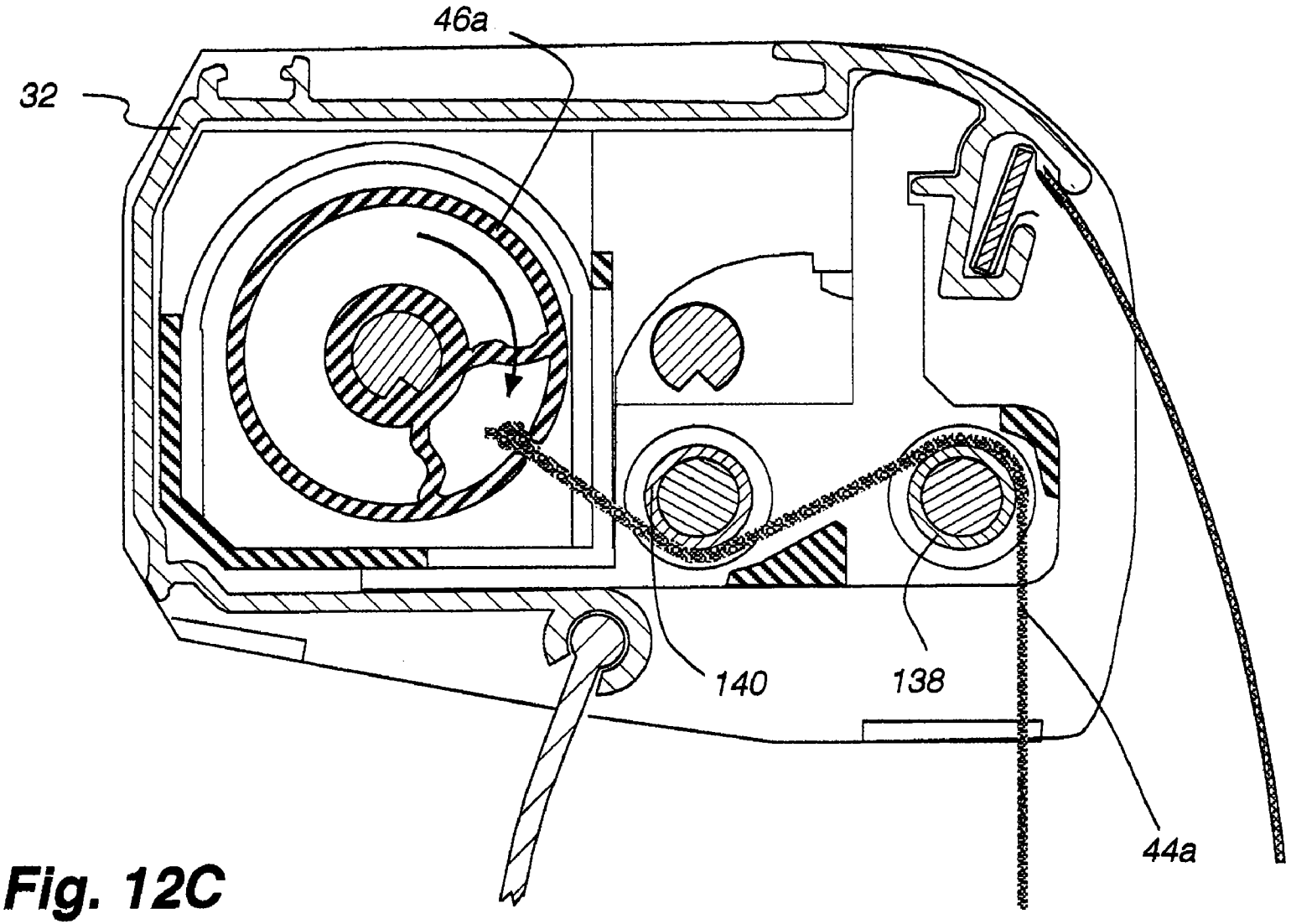
FIG. 12C is a section similar to FIG. 12B with the spool rotated slightly further in a clockwise direction.
Figure 12D:
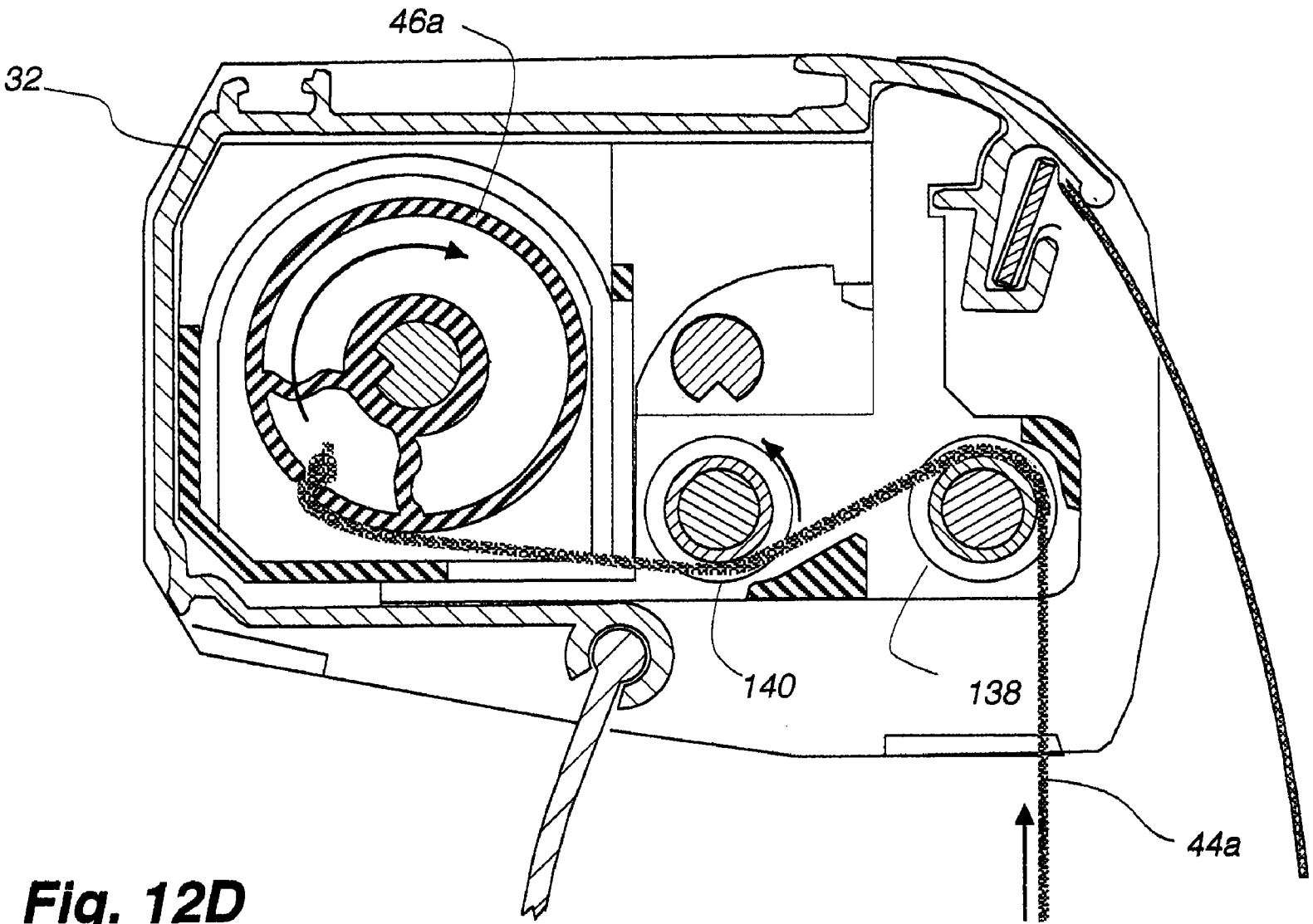
FIG. 12D is a section similar to FIG. 12C with the spool having been rotated even further in a clockwise direction.
Figure 13:
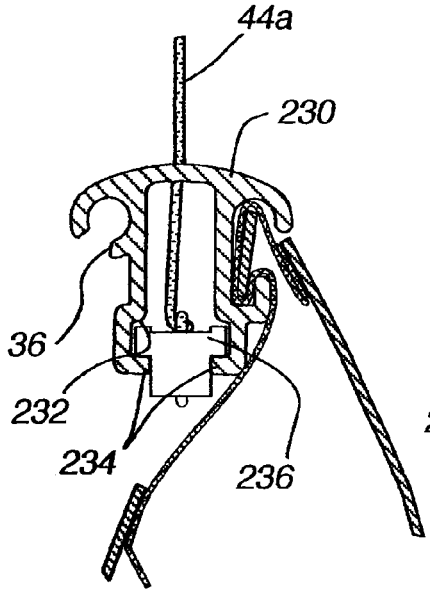
FIG. 13 is an enlarged section taken along line 13-13 of FIG. 2.
Figure 14A:
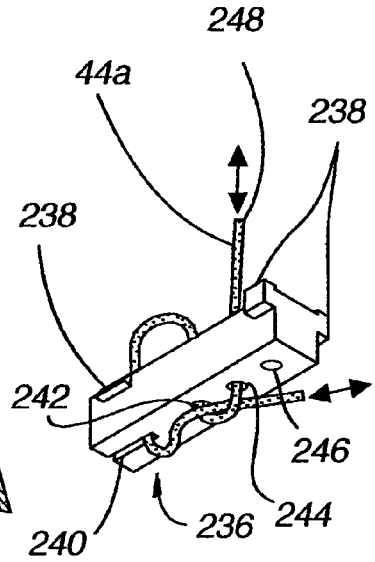
FIG. 14A is an isometric looking at the bottom of an anchor block for securing a lift cord to the middle rail with the lift cord being loosely connected to the anchor block.
Figure 14B:
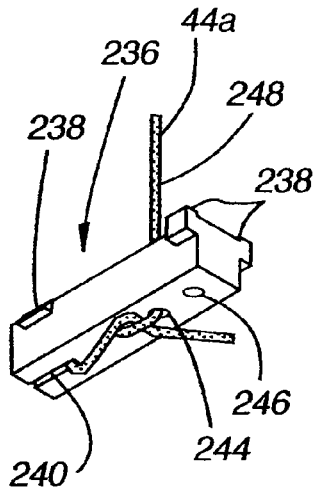
FIG. 14B is an isometric similar to 14A with the lift cord having been tightened to the anchor block.
Figure 15:
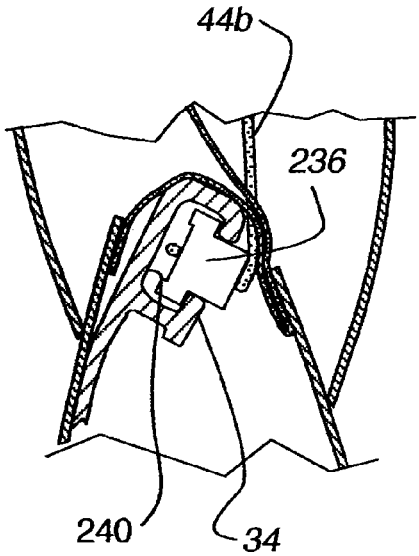
FIG. 15 is a section taken along line 15-15 of FIG. 2.
Figure 16A:
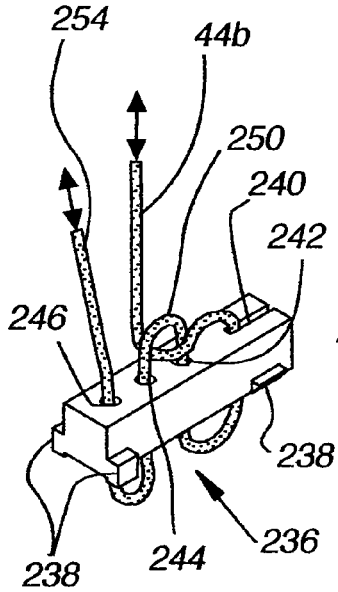
FIG. 16A is an isometric looking downwardly on the anchor block shown in FIGS. 14A and 14B with the lift cord being threaded from an opposite side as when the anchor block is used with the bottom rail as shown in FIG. 15 and with the lift cord being loosely threaded.
Figure 16B:
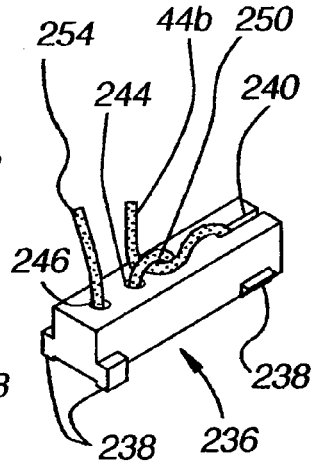
FIG. 16B is an isometric similar to FIG. 16A with the lift cord being tightened.

The operation of the middle rail 36 is illustrated in FIGS. 12A through 12D where it will be seen the spools 46*a* as mentioned previously associated with the middle rail are positioned rearwardly of the spools 46*b* associated with the bottom rail 34 and accordingly the lift cords 44*a* associated with the middle rail first pass beneath the rear pulley 140 associated with the spool and subsequently across the top of the front pulley 138 associated with the spool and then downwardly to an attachment with the middle rail. The operation of the middle rail is identical to the bottom rail except it is controlled by the control element 50 at the opposite end of the head rail 32. As seen in FIG. 12A, the lift cord 44*a* associated with the middle rail is wrapped about its associated spool 46*a* and is being rotated in a clockwise direction to lower the middle rail. In FIG. 12B, the middle rail is substantially lowered. When the middle rail is fully lowered, the lift cord and spool are positioned as shown in FIG. 12C. At this point in operation, the control element can be continued to be rotated in the clockwise direction in which case the middle rail will begin to raise as the lift cord wraps around the spool in the opposite direction as shown in FIG. 12D. As mentioned previously, however, with regard to the bottom rail, the direction of rotation of the control element can be reversed at any time to wrap the lift cords about the spools in an opposite direction.

Referencing FIGS. 1A and 13-16B, it will be appreciated the middle rail 36 and bottom rail 34 have different characteristics with the middle rail being of a generally tubular cross-section having an upwardly convex top wall 230 adapted to mate with the downwardly concave seat 102 in the abutment stop 94. The bottom of the middle rail has a longitudinal slot 232 formed therein defined by a pair of inwardly turned lips 234 so that an anchor block 236 for an associated lift cord 44*a* can be secured to the middle rail. As viewed in FIG. 15, the bottom rail 36 defines an arcuate dummy-like vane 238 having a groove 240 formed along its top edge with the groove also having inwardly turned lips 242 so that an identical anchor block 236 to that shown in FIG. 16 can be secured.

While the anchor blocks 236 used to secure a lift cord 44*a* to the middle rail 36 are identical to the anchor blocks 236 used to secure a lift cord 44*b* to the bottom rail 34, they are connected differently. With reference to FIGS. 14A, 14B, 16A, and 16B, the anchor block 236 can be seen to be of a generally quadrilateral transverse cross-section having laterally protruding supports 238 at opposite ends thereof adjacent one surface of the block. A slot 240 is formed in one end of the block and three aligned vertical passages 242, 244 and 246 extend through the block. To thread a lift cord 44*a* into an anchor block 236 for use in the middle rail so that it is secured thereto, as viewed in FIG. 14A, the end of the lift cord designated 248 which will extend upwardly to the head rail 32 is held above one end of the block and the remainder or lower end of the lift cord is threaded downwardly through the center vertical passage 244 in the block and then upwardly through the adjacent passage 242 forming a loop 250 below the block before the lift cord is again inserted downwardly through the slot 240 and finally through the loop 250 below the block. By then pulling on the ends of the lift cord, the cord can be tightened against the block and secured at a predetermined position along the length of the lift cord. The block can then be slid into the open end of the middle rail 34 and the lift cord extended through slots 252 (FIG. 1A) provided in the upwardly convex surface of the middle rail for its passage to the associated spool 46*a* in the head rail 32. Obviously, the block is confined within the slot 232 along the bottom of the middle rail by the inturned lips 234.

Similarly for the bottom rail 34, the block 236 is threaded from the reverse side so that the block is first inverted and the end 254 of the cord which will extend upwardly to the head rail 32 is held so that the remainder of the cord can be inserted downwardly through one end passage 246, upwardly through the middle passage 244 to form a loop 250 above the block and then downwardly through the other end passage 242 before being brought up through the slot 240 in the end of the block and then inserted through the loop 250. Again, by thereafter pulling on the ends of the cord, the loop can be tightened against the block to secure the cord 44*b* to the block. The block can then be slid into the open end of the groove 240 in the bottom rail 34 to be positioned in alignment with its associated spool. The lift cords 44*b* from the bottom rail as seen in FIG. 1A will pass through the same slots 252 in the middle rail 36 as the lift cords 44*a* associated with the middle rail.

Although the present invention has been described with a certain degree of particularity, it is understood the disclosure has been made by way of example and changes in detail or structure may be made without departing from the spirit of the invention as defined in the appended claims.

The invention claimed is:

1. A covering for an architectural opening comprising:

a head rail, a bottom rail an intermediate rail, blind material interconnecting said bottom and intermediate rails, a first control system interconnecting said head rail and said intermediate rail, said first control system including at least two flexible first lift elements, a first horizontal drive shaft in said head rail having at least two first wrap surfaces operatively associated therewith and about which at least one of said at least first lift elements can be wrapped, a first operating element for selectively and reversibly rotating said first drive shaft whereby said at least one of said first lift elements can be wrapped about or unwrapped from said first wrap surfaces, and a first releasable brake system for preventing rotation of said first drive shaft when it is not rotated by said first operating element, a second control system interconnecting said head rail and said bottom rail, said second control system including at least two flexible second lift elements, a second horizontal drive shaft in said head rail having at least two second wrap surfaces operatively associated therewith and about which at least one of said at least second lift elements can be wrapped, a second operating element for selectively and reversibly rotating said second drive shaft whereby said at least one of said second lift elements can be wrapped about or unwrapped from said second wrap surfaces, and a second releasable brake system for preventing rotation of said second drive shaft when it is not rotated by said second operating element, and a pair of separate cradles, each respective cradle receiving both of said drive shafts, and wherein each respective cradle receives at least one of the at least two first wrap surfaces and at least one of the at least two second wrap surfaces.

2. The covering of claim 1 wherein said first wrap surfaces in said first control system are first spools mounted on said first drive shaft of said first control system for unitary rotation therewith.

3. The covering of claim 2 wherein said first spools are rotatably seated in said separate cradles.

4. The covering of claim 3 wherein said separate cradles are mounted on said head rail.

5. The covering of claim 3 wherein said second wrap surfaces in said second control system are second spools mounted on said second drive shaft of said second control system for unitary rotation therewith.

6. The covering of claim 5 wherein said second spools in said second control system are rotatably seated in said separate cradles.

7. The covering of claim 1 wherein said head rail has a front and a back and wherein said drive shaft for one of said control systems is in front of said drive shaft for the other of said control systems.

8. The covering of claim 1 wherein each of said releasable brake systems is a two-way clutch.

9. The covering of claim 1 wherein said first and second operating elements are flexible cords operatively engaged with said first and second drive shafts respectively.

10. The covering of claim 9 wherein said first and second operating elements are endless cords.

* * * * *